US012624491B2

(12) United States Patent
Catanzani et al.

(10) Patent No.: US 12,624,491 B2
(45) Date of Patent: May 12, 2026

(54) MICROPARTICLE FILTRATION DETECTION FOR A LAUNDRY APPLIANCE

(71) Applicant: WHIRLPOOL CORPORATION, Benton Harbor, MI (US)

(72) Inventors: Riccardo Catanzani, Perugia (IT); Giacomo Marvardi, Terre Roveresche (IT); Omar Rachid Murad, Rio Claro (BR); Guglielmo Roelfsema, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 114 days.

(21) Appl. No.: 18/409,068

(22) Filed: Jan. 10, 2024

(65) Prior Publication Data

US 2024/0247424 A1 Jul. 25, 2024

Related U.S. Application Data

(60) Provisional application No. 63/454,781, filed on Mar. 27, 2023, provisional application No. 63/440,472, filed on Jan. 23, 2023.

(51) Int. Cl.

| | |
|---|---|
| ***D06F 34/20*** | (2020.01) |
| ***D06F 39/10*** | (2006.01) |
| ***D06F 39/14*** | (2006.01) |
| ***D06F 58/50*** | (2020.01) |
| *D06F 103/40* | (2020.01) |
| *D06F 103/42* | (2020.01) |
| *D06F 105/44* | (2020.01) |
| *D06F 105/58* | (2020.01) |

(52) U.S. Cl.
CPC ..... *D06F 39/10* (2013.01); *D06F 34/20* (2020.02); *D06F 39/14* (2013.01); *D06F 58/50* (2020.02); *D06F 2103/40* (2020.02); *D06F 2103/42* (2020.02); *D06F 2105/44* (2020.02); *D06F 2105/58* (2020.02)

(58) Field of Classification Search
CPC ..... D06F 34/20; D06F 39/10; D06F 39/14; D06F 58/50; D06F 2103/40; D06F 2103/42; D06F 2105/44; D06F 2105/58
See application file for complete search history.

(56) References Cited

U.S. PATENT DOCUMENTS

2004/0159008 A1 8/2004 Harpenau
2013/0312201 A1* 11/2013 Frucco ..... D06F 39/10 68/18 F
2022/0008845 A1* 1/2022 Girondi ..... D06F 39/083
(Continued)

FOREIGN PATENT DOCUMENTS

EP 2351882 B1 8/2015
WO 2012069288 A1 5/2012

*Primary Examiner* — Joseph L. Perrin
(74) *Attorney, Agent, or Firm* — Price Heneveld LLP

(57) ABSTRACT

A laundry appliance includes a filter that accumulates microparticles in a fluid path, a pressure sensor having a membrane that moves from an initial position toward a saturated position in response to the accumulation of the microparticles, an arm operably coupled with the pressure sensor, and a retention feature interposing the arm and the filter to operably couple the pressure sensor with the filter, wherein the retention feature maintains the membrane in the saturated position in response a threshold saturation of the filter with the microparticles.

20 Claims, 14 Drawing Sheets

(56) References Cited

U.S. PATENT DOCUMENTS

| | | | | |
|---|---|---|---|---|
| 2022/0154385 | A1 | 5/2022 | Antell | |
| 2023/0055113 | A1* | 2/2023 | Murad | D06F 33/32 |
| 2024/0052545 | A1* | 2/2024 | Cho | B01D 35/143 |
| 2024/0238702 | A1* | 7/2024 | Lawrance-Owen | B01D 29/114 |

* cited by examiner

252

| | | | | | | | | | |
|---|---|---|---|---|---|---|---|---|---|
| INPUT | Door Locked | Locked | Locked | Locked | Locked | Unlocked | Unlocked | Unlocked | Unlocked |
| | Clogged | TRUE | TRUE | FALSE | FALSE | TRUE | TRUE | FALSE | FALSE |
| | Filter | IN | OUT | IN | OUT | IN | OUT | IN | OUT |
| OUTPUT | LED | OFF | OFF | OFF | OFF | ON | ON | OFF | ON |
| | ENABLE | ON | ON | ON | ON | OFF | OFF | ON | OFF |

FIG. 11

MICROPARTICLE FILTRATION DETECTION FOR A LAUNDRY APPLIANCE

CROSS-REFERENCE TO RELATED APPLICATIONS

This application claims priority to and the benefit under 35 U.S.C. § 119(e) of U.S. Provisional Patent Application No. 63/440,472, filed on Jan. 23, 2023, entitled MICROFIBER FILTRATION ASSEMBLY FOR A LAUNDRY APPLIANCE AND A LAUNDRY APPLIANCE INCORPORATING THE SAME, and U.S. Provisional Patent Application No. 63/454,781, filed Mar. 27, 2023, entitled MICROFIBER FILTRATION DETECTION FOR A LAUNDRY APPLIANCE, the entire disclosures of which are hereby incorporated herein by reference.

FIELD OF THE DISCLOSURE

The device generally relates to microparticle filtration for a laundry appliance and, more specifically, relates to sensors for detecting accumulation of microparticles on fine-particle filters for laundry appliances.

SUMMARY OF THE DISCLOSURE

According to another aspect of the present disclosure, a laundry appliance includes a controller configured to operate the laundry appliance in response to an enable signal, a lock detection circuit that monitors a lock of a door for the laundry appliance, the lock detection circuit configured to selectively communicate the enable signal, a filter detection circuit electrically interposing the lock detection circuit and the controller and monitoring a filter of the laundry appliance, and a bypass circuit electrically interposing the lock detection circuit and the controller, wherein the lock detection circuit is configured to communicate the enable signal to the controller via the filter detection circuit when the door is unlocked, and further configured to communicate the enable signal via the bypass circuit when the door is locked.

According to another aspect of the present disclosure, a laundry appliance includes a tub positioned within an outer cabinet, a drum that is rotationally operable within the tub, a fluid pump that directs a process fluid through a fluid path that includes the tub, and a filter that accumulates microparticles in the fluid path, a pressure sensor having a membrane that moves from an initial position in response to the accumulation of the microparticles, an arm operably coupled with the pressure sensor, and a retention feature interposing the arm and the filter to operably couple the pressure sensor with the filter, wherein the retention feature maintains the membrane away from the initial position in response to the accumulation of the microparticles within the filter.

According to an aspect of the present disclosure, a filtration assembly for a laundry appliance includes a filter that captures microparticles in a fluid path. A pressure sensor has a membrane that moves from an initial position in response to a decrease in a fluid flow through the filter. An arm is operably coupled with the pressure sensor. A retention feature interposes the arm and the filter to operably couple the pressure sensor with the filter. The retention feature biases or maintains the membrane away from the initial position in response to the decrease in the fluid flow through the filter and the filter remaining in the fluid path.

According to another aspect of the present disclosure, a laundry appliance includes a tub positioned within an outer cabinet. A drum is rotationally operable within the tub. A fluid pump directs a process fluid through a fluid path that includes the tub. A filtration assembly is in the fluid path and includes a filter that accumulates microparticles in the fluid path. A pressure sensor has a membrane that moves from an initial position in response to the accumulation of the microparticles. An arm operably couples with the pressure sensor. A retention feature interposes the arm and the filter to operably couple the pressure sensor with the filter. The retention feature biases or maintains the membrane away from the initial position in response to the accumulation of the microparticles within the filter.

According to another aspect of the present disclosure, a filtration assembly for a laundry appliance includes a filter that captures microparticles in a fluid path. A pressure sensor has a housing that defines a chamber and a hole in communication with the chamber. The pressure sensor includes a membrane that is disposed in the housing and moves from an initial position in response to a decrease in a fluid flow through the filter. An arm extends through the passage and is operably coupled with the membrane. A magnetic connection is between the arm and the filter. The magnetic connection biases the membrane away from the initial position in response to the decrease in the fluid flow through the filter and the filter remaining in the fluid path.

According to another aspect of the present disclosure, a filtration assembly for a laundry appliance includes a filter that captures microparticles in a fluid path. A pressure sensor has a housing that defines a chamber and a hole in communication with the chamber. The pressure sensor includes a membrane that is disposed in the housing and moves from an initial position toward an extended position in response to a decrease in a fluid flow through the filter. An arm extends through the passage and is operably coupled with the membrane. A magnetic connection is between the arm and the filter. The magnetic connection latches the membrane in the extended position in response to the membrane moving into the extended position.

According to another aspect of the present disclosure, a filtration assembly for a laundry appliance includes a filter that captures microparticles in a fluid path. A pressure sensor has a membrane that moves from an initial position in response to a decrease in a fluid flow through the filter. An arm is operably coupled with the pressure sensor. A biasing member moves toward a compressed position in response to engaging the filter at a first end of the biasing member and the arm at a second end of the biasing member. The arm defines a notch that receives the biasing member to bias the membrane away from the initial position in response to the decrease in the fluid flow through the filter and the filter remaining in the fluid path.

According to another aspect of the present disclosure, a control circuit for a laundry appliance includes a controller configured to operate the laundry appliance in response to an enable signal. A lock detection circuit monitors a lock of a door for the laundry appliance. The lock detection circuit is configured to selectively communicate the enable signal. A filter detection circuit electrically interposes the lock detection circuit and the controller and monitors a filter of the laundry appliance. A bypass circuit electrically interposes the lock detection circuit and the controller. The lock detection circuit is configured to communicate the enable signal to the controller via the filter detection circuit when the door is unlocked and communicate the enable signal via the bypass circuit when the door is locked.

These and other features, advantages, and objects of the present disclosure will be further understood and appreciated by those skilled in the art by reference to the following specification, claims, and appended drawings.

BRIEF DESCRIPTION OF THE DRAWINGS

In the drawings:

FIG. 11 is a logic table for an exemplary control circuit of a laundry appliance.

Figure 1:
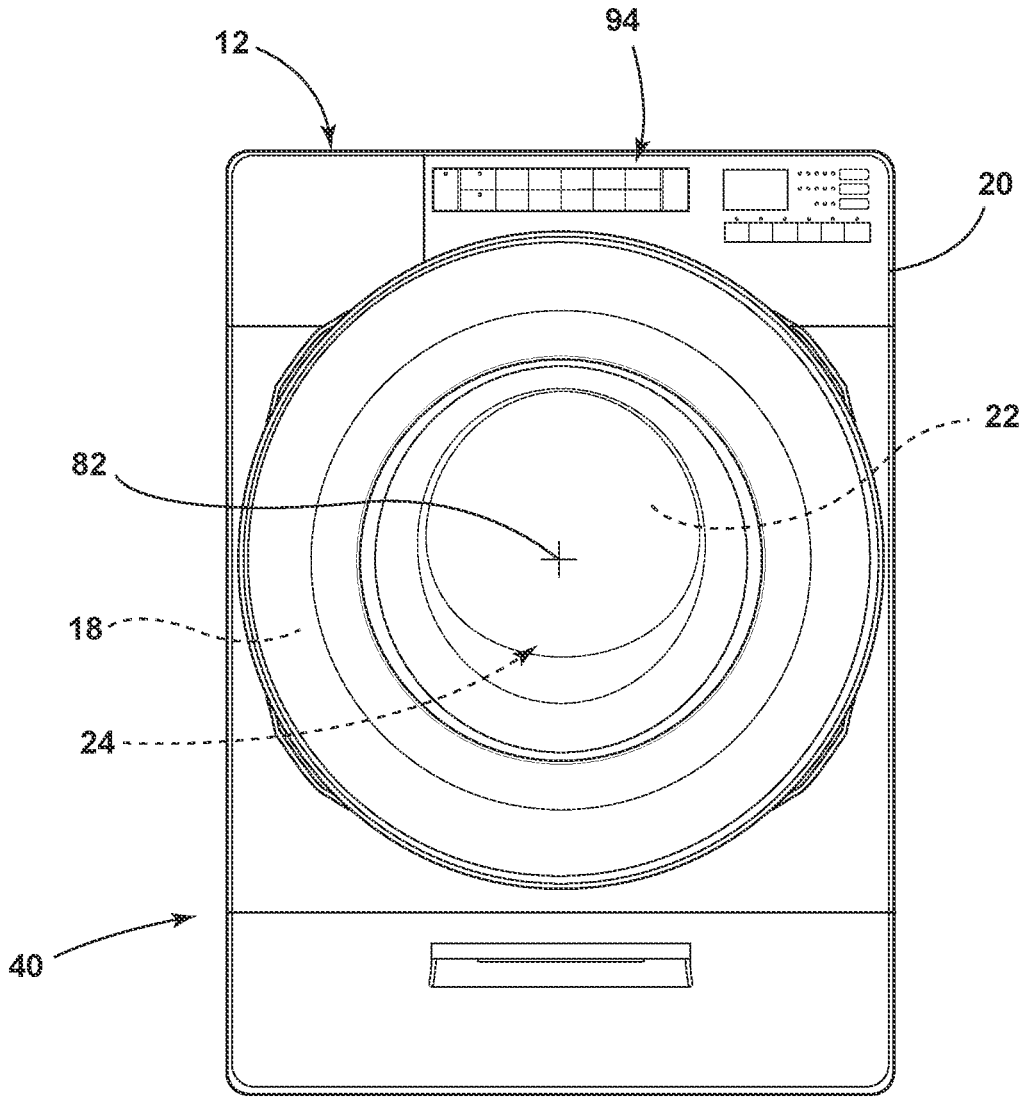
FIG. 1 is a front-elevation view of a front-load washing appliance that incorporates an aspect of the fine-particle filter.

The components in the figures are not necessarily to scale, emphasis instead being placed upon illustrating the principles described herein.

DETAILED DESCRIPTION

The present illustrated embodiments reside primarily in combinations of method steps and apparatus components related to microfiber detection for a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-6B, reference numeral 10 generally refers to a filtration assembly that is installed within a laundry appliance 12. The filtration assembly 10 is configured with an interference function to limit operation of the laundry appliance 12 until a filter 14 of the filtration assembly 10 is removed and re-inserted following a saturation condition of the filter 14. In some examples, the interference function is a toggling function. For example, the filter 14 can be a fine-particle filter that is installed within the laundry appliance 12. The filter 14 can be used for separating micro-sized particles that are carried through a fluid path 15 by a process fluid 16. Typically, these micro-sized particles are present in the process fluid as a result of processing laundry articles that are made from various micro-sized fiber materials. It is contemplated that the filter 14 can be used to capture other small particles and micro-sized particles that may be present in the fluid path 15.

According to various aspects of the device, the laundry appliance 12 includes a tub 18 that is positioned within an outer cabinet 20. A drum 22 is rotationally operable within the tub 18 and defines a processing space 24, within which laundry articles are processed. A fluid pump 26 directs the process fluid 16 through the fluid path 15. The fluid path 15 includes the tub 18 and the processing space 24 of the rotating drum 22. The filtration assembly 10 is in communication with the fluid path 15 and includes the filter 14. The filter 14 captures and accumulates microparticles 28 from the process fluid 16. The filtration assembly 10 further includes a pressure sensor 30 having a membrane 32 that moves away from an initial position 33 toward a saturated position in response to the accumulation of the microparticles 28. The filtration assembly 10 further includes an arm 34 operably coupled with the pressure sensor 30. A retention feature 36 interposes the arm 34 and the filter 14 to operably couple the pressure sensor 30 with the filter 14. The retention feature 36 maintains the membrane 32 in the saturated position in response to a threshold saturation of the filter 14 with the microparticles 28. For example, the retention feature 36 can bias the membrane 32 away from the initial position 33 in response to the accumulation of the microparticles 28 and the filter 14 remaining in the fluid path 15.

According to various aspects of the device, microparticles 28 are very small micro-sized fibers that are typically made of plastic fibers or plastic-associated fibers that are too small for conventional filters to capture. Such micro-sized fibers if unfiltered, may be delivered to various external drains 38 via a drain conduit 39 and into a water supply or into the groundwater. The filtration assembly 10 described herein provides for detecting accumulation of the microparticles 28 in or on the fine-particle filter 14. The filtration assembly 10 provides a mechanism for providing an interference function between the pressure sensor 30 (e.g., a pressure switch) and the filter 14 that requires removal of the filter 14 from the laundry appliance 12 in order to reset the retention feature 36 and pressure sensor 30. For example, the retention feature 36 can include a latch or other interface that provides the interference function, which may include a latching/unlatching function, a locking function, a toggling function (e.g., maintaining a certain position until an unlatching event occurs), or the like. The present interference implementation can limit additional wiring and/or changes in hardware or software to a control system for the laundry appliance 12. Rather, the interference implementation described herein can employ mechanical or electro-mechanical mechanisms to achieve the interference function.

Figure 2:
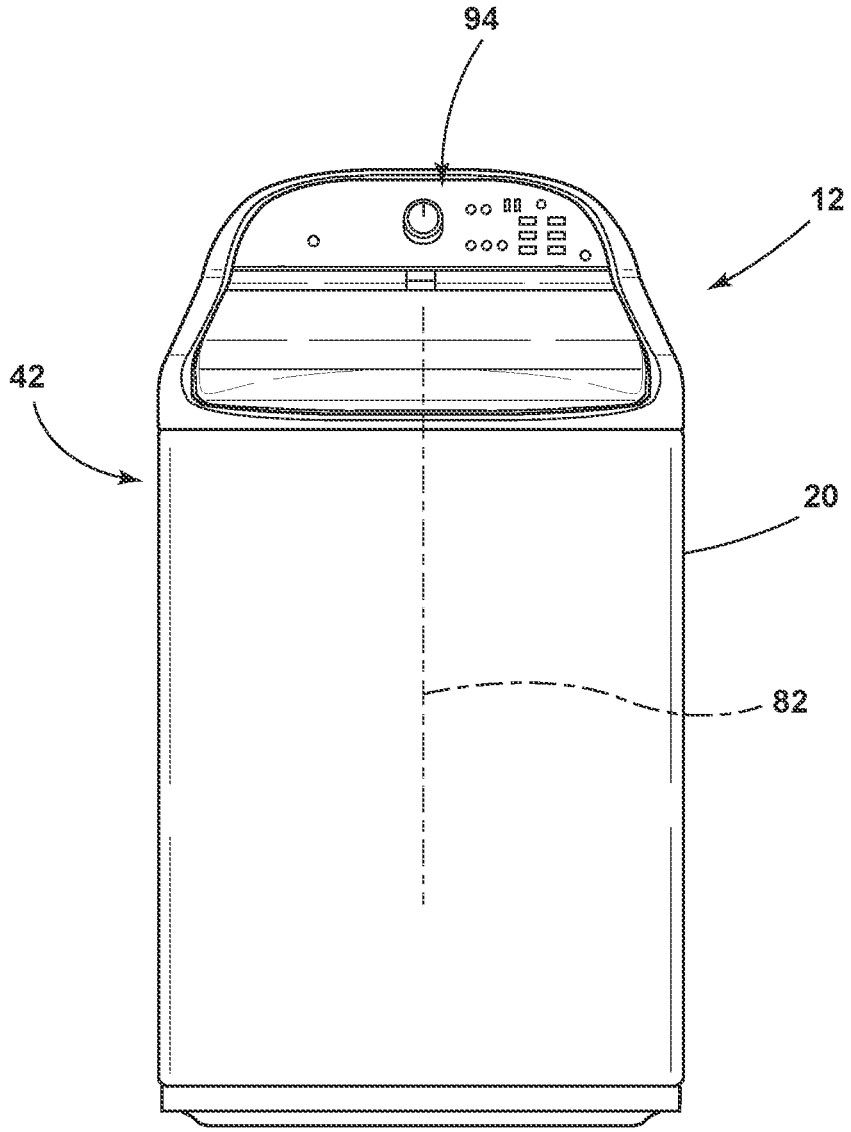
FIG. 2 is a front-perspective view of a top-load washing appliance that incorporates an aspect of the fine-particle filter.

Referring more particularly to FIGS. 1 and 2, it is contemplated that the fine-particle filter 14 can be disposed within any one of various laundry appliances. Such appliances can include, but are not limited to, front-load appliances 40, top-load appliances 42, washers, dryers, combination washers and dryers, and other similar appliances that are used for processing laundry and which may result in the release of microparticles 28 into the processing space 24 of the particular appliance. Additionally, it is contemplated that the fine particle filter 14 can be used within any appliance connected with an external water supply. In this manner, water can be filtered before use, such as in the case of a refrigerator, dish washer, water heater, water cooler, or other similar appliance. Accordingly, the fine particle filter 14 can be used as a general filtration mechanism to remove micro-sized particles from a water supply to prevent consumption and to prevent introduction or reintroduction of these micro-sized particles into the groundwater and/or the water supply.

Figure 3:
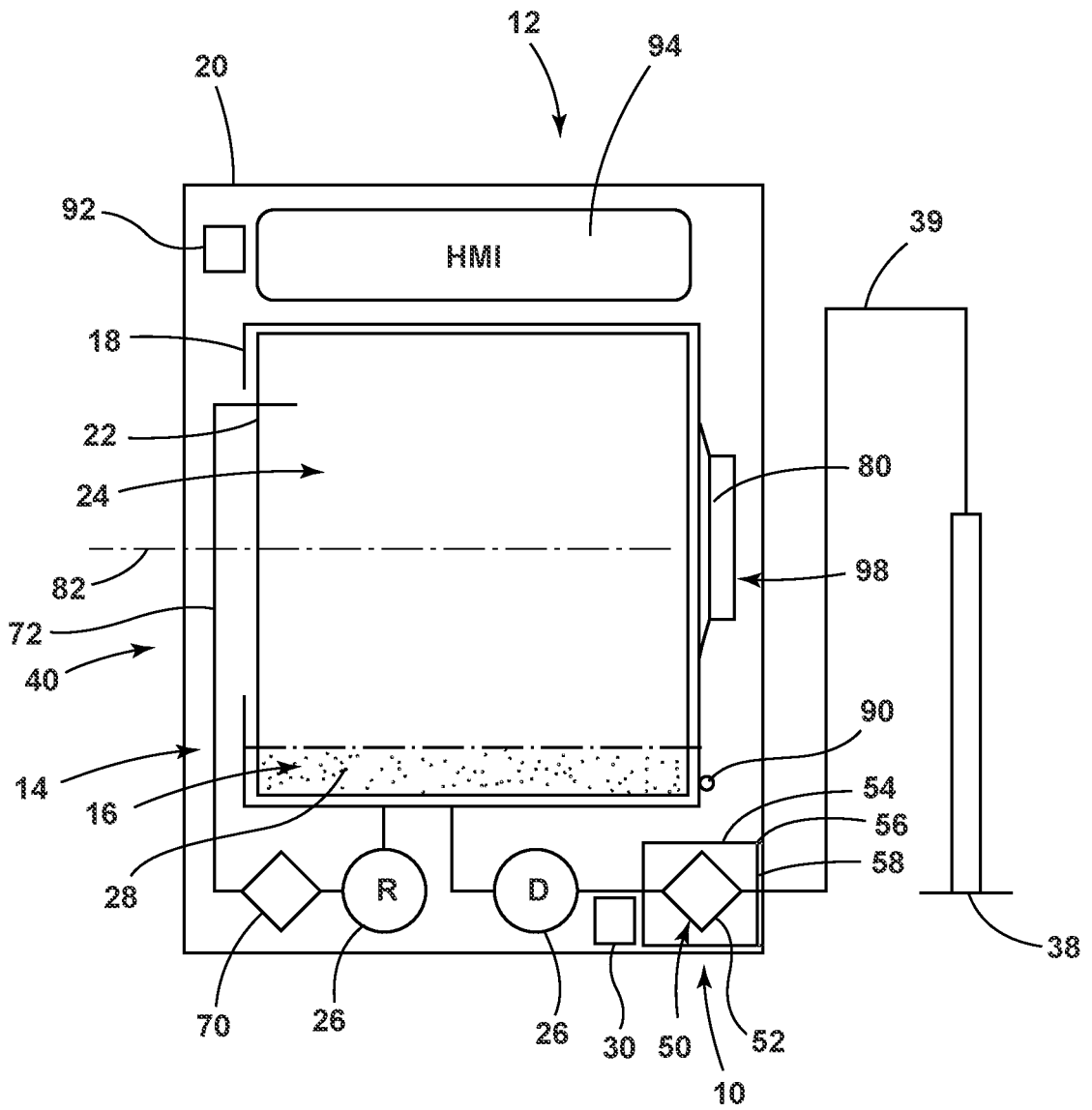
FIG. 3 is a schematic cross-sectional view of a laundry appliance that includes a fine-particle filter within a drain channel and within a filter receptacle that is accessible through the outer cabinet of the appliance.

Referring now more particularly to FIG. 3, it is contemplated that the fine-particle filter 14 can include at least one container 52, such as a cartridge 50 or other collection space, that is selectively removed from the outer cabinet 20 of the appliance 12 so that the microparticles 28 can be transferred to a recycling facility or other disposal facility without being removed from the container 52 for the fine-particle filter 14. Accordingly, the filtration assembly 10 may include a filter housing 54 that incorporates the filter 14. The cartridge 50 can be positioned within the filter housing 54 and can also be selectively removed from the filter housing 54 and the fluid path 15 for disposing of the captured microparticles 28. This filter housing 54 is typically accessible via an exterior of the outer cabinet 20. In this manner, the outer cabinet 20 can include an aperture 56 and a door 58 or other panel that can be operated for accessing, removing, and replacing necessary portions of the fine-particle filter 14 for capturing and containing the microparticles 28. It is contemplated that the container 52 and the fine particle filter 14 can be accessed from the front, side, top, or rear of the cabinet 20.

With continued reference to FIG. 3, the fluid path 15 for the appliance 12 can include a primary filter 70 that is configured for capturing larger-sized particles of lint and other material that may be separated from the articles being processed within the drum 22 of the appliance 12. Such larger particles can include lint, other particulate material, objects that may be left within clothing pockets, and other foreign items that may find their way into the processing space 24 of the appliance 12. This primary filter 70 has a mesh size that is larger than the size of the microparticles 28 that are intended to be captured by the fine-particle filter 14. Accordingly, during operation of the appliance 12, the process fluid 16 moves through the primary filter 70 where larger objects and larger particulate can be captured and separated from the process fluid 16. Subsequently, and downstream from the primary filter 70, the fine-particle filter 14 can be used to capture microparticles 28 and separate these microparticles 28 from the process fluid 16. Accordingly, the primary filter 70 is positioned upstream of the fine-particle filter 14. Additionally, the fine particle filter 14 is typically positioned proximate an outlet or drain of the appliance so that the process fluid can be filtered before leaving the appliance.

According to the various aspects of the device, process fluid 16 can include, but is not limited to, water, air, detergent and other laundry chemistry, particulate and soil from processed articles, microparticles 28, and other ingredients and byproducts of laundry cycles.

Use of the primary filter 70 in capturing larger particles can extend the life of the fine-particle filter 14 by allowing only microparticles 28 to engage a filter member of the fine-particle filter 14. It is contemplated that the primary filter 70 will be cleaned or otherwise maintained after each load of laundry, daily, weekly or other similar short period of time. In this manner, only the microparticles 28 pass through the primary filter 70 to be captured by the fine-particle filter 14. Using this configuration, the fine-particle filter 14 may be cleaned, replaced, or otherwise maintained monthly, every other month, or some other longer period of time.

With continued reference to FIG. 3, the primary filter 70 may be located within a recirculating fluid path 72 and the fine-particle filter 14 may be positioned downstream of the primary filter 70, either within the recirculating fluid path 72 or within the drain conduit 39, or both. During operation of the appliance 12, the recirculating fluid path 72 is utilized during washing-type phases, such as an agitating phase, wherein the drum 22 rotates at a relatively slow rate of speed, or oscillates at a relatively slow rate of speed. During these washing-type phases, process fluid 16 is likely to be kept within the drum 22, or recirculated through the recirculating fluid path 72. Alternatively, the drum 22 rotates at a much higher rate of speed during a spin cycle or other drain phase of the appliance 12 when process fluid 16 is extracted from the drum 22 and delivered to the external drain 38.

It is contemplated that each of the filters 14, 70 can be selectively removed from the appliance 12. With respect to the fine-particle filter 14, removal of the fine-particle filter 14, or a portion thereof, is intended to contain the captured microparticles 28 and prevent the release of the microparticles 28. In this manner, as described herein, the microparticles 28 that are contained within the fine-particle filter 14 can be captured within a storage area. Accordingly, the fine-particle filter 14 includes the container 52 which is meant to capture and secure the microparticles 28 for later disposal and recycling.

Referring again to FIG. 3, the container 52 for the fine-particle filter 14 can be in the form of a removable cartridge 50 that includes the filter 14 having one or more filtration layers through which the process fluid 16 is delivered. As the process fluid is directed through the filtration layers of the filter, the filtration layers separate the microparticles 28 from the process fluid. The microparticles 28 are retained in the filter and the now filtered process fluid is directed downstream to the drain This cartridge 50 is typically a removable member that can be removed from the filter housing 54 for the fine-particle filter 14. A cleaned, refurbished, or new cartridge 50, including a new filter, can then be reinserted into the filter housing 54 for further filtration of the process fluid 16 to remove microparticles 28. The removed cartridge 50, which may include the filter 14, that is saturated with microparticles 28 can be delivered to a particular facility for disposal and/or recycling of the microparticles 28.

Referring again to FIG. 3, the laundry appliance 12 includes a motor 80 that operates the drum 22 about a rotational axis 82. The fluid pump 26 directs the process fluid 16 through the fluid path 15 that includes the tub 18. Delivery of the process fluid 16 through the fine-particle filter 14 can result in a more gradual flow of the process fluid 16 through the fluid path 15. This gradual flow of the process fluid 16 allows for a more complete filtration of the process fluid through a finer mesh size of the fine-particle filter 14, as compared to the primary filter 70. The flow of the process fluid through the fine particle filter can also be gradually slowed over time as the accumulation and saturation of microparticles 28 within the fine-particle filter 14 progresses.

When saturated with microparticles 28 in the saturation condition, the flow of process fluid 16 through the fine-particle filter 14, if not addressed, is slowed. Stated another way, as the process fluid 16 moves through the fine-particle filter 14 and the volume of microparticles 28 accumulates, the flow of process fluid 16 can be slowed. Accordingly, because of the slowed volume of the process fluid 16 through the fine-particle filter 14, the process fluid 16 may accumulate within the tub 18 due to the consistent velocity and flow of fluid into the tub 18. To account for this potential, the filtration assembly 10 adjusts the operation of the appliance to provide for the continued movement of process fluid through the fine particle filter and to the outlet.

Figure 4:
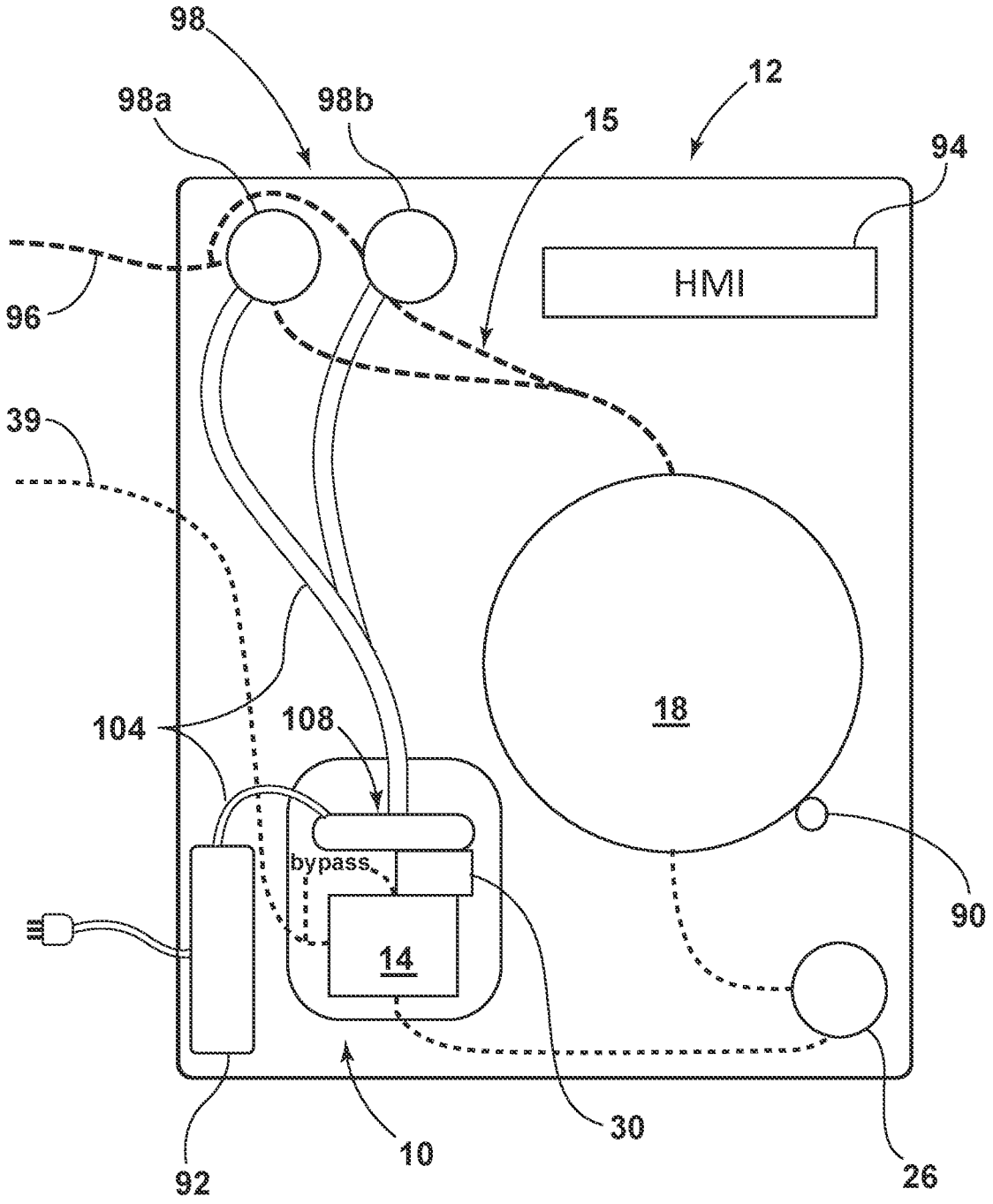
FIG. 4 is a schematic view of a laundry appliance incorporating an exemplary filtration assembly of the present disclosure demonstrating electrical and fluid connections with electrical valves that control fluid flow from a fluid inlet to the laundry appliance.

With continued reference to FIGS. 3 and 4, in order to accommodate the gradual flow of process fluid 16 from the tub 18 and through the fine-particle filter 14, as well as preventing the increased fluid level of the process fluid 16 within the tub 18 during a microfiber capturing phase, various sensors communicate with a controller 92 to modify operation of the appliance to account for the gradual flow of the process fluid. In this manner, the sensors provide information to the controller regarding certain fluid-related parameters relevant to the fine-particle filter. The controller, in turn, operates the motor 80 and the one or more fluid pumps 26 to manage the gradual flow of process fluid through the fine particle filter. These sensors can be in the form of a fluid level sensor 90 that is positioned within or near the tub 18. This fluid level sensor 90 monitors an amount of process fluid 16 that has accumulated within the tub 18. The sensors can also include a fluid flow sensor that measures an amount of process fluid 16 that is delivered either into the tub 18, away from the tub 18, out of the fine particle filter, or a combination thereof. Other configurations and types of sensors can be used for monitoring the handling of the process fluid 16 through the tub 18 and through the fine-particle filter 14. For example, as will be further described in detail below, the pressure sensor 30 of the filtration assembly 10 may be configured to detect the saturation condition.

With continued reference to FIGS. 3 and 4, to monitor the flow of process fluid 16 through the fine-particle filter 14, the various sensors including the fluid level sensor 90 and/or fluid flow sensors can be positioned within the fluid path 15 or within the tub 18. The various sensors may further include the pressure sensor 30. The pressure sensor 30 may be positioned upstream of the fine-particle filter 14, downstream of the fine-particle filter 14, or both to determine whether the flow of the process fluid 16 through the fine-particle filter 14 is being impeded by a saturated condition of the fine particle filter.

In a preferred example, the pressure sensor 30 is disposed in close proximity to the fine particle filter 14 and the filter housing 54. The flow of process fluid 16, when slowed, can also result in an increase in the amount of process fluid 16 within the tub 18. As a result, the fluid level of the process fluid 16 within the tub 18 can be measured using the pressure sensor 30 within the fluid path 15 of the appliance 12. The pressure sensor 30 can measure the amount of process fluid 16 within the tub 18 based upon a ratio of a particular water column over time.

For example, as will further be described herein, the pressure sensor 30 may have an air connection with the tub 18 or another portion of the fluid path 15 and, as water accumulates in areas of the fluid path 15, the pressure of the air may increase and cause the pressure sensor 30 to detect the saturation condition of the filter 14. It is also contemplated that the amount of process fluid 16 within the tub 18 can also be measured by various pressure monitors, floats, fluid flow monitors that monitor an amount of process fluid 16 entering the tub 18 versus an amount of process fluid 16 leaving the tub 18, and other similar sensors that can be used for measuring, or estimating, an amount of process fluid 16 within the tub 18.

Various notifications regarding the fine-particle filter 14 as well as the primary filter 70 can be delivered to the user via a user interface of the appliance 12 or other human-machine interface (HMI) 94. The HMI 94 can interact with a user to inform the user concerning the status of the fine-particle filter 14 and the primary filter 70. The HMI 94 can also send messages to a portable computing device, such as a smart phone, tablet, wearable device, or other similar computing device. Messages can be sent from the HMI 94 to the portable computing device for alerting a user that a particular portion of the fine-particle filter 14 and/or the primary filter 70 requires maintenance or otherwise requires some form of attention. For example, the HMI 94 may be configured to present a message indicating removal of the fine-particle filter 14 is necessary to resume a laundry operation of the laundry appliance 12 or to begin a subsequent laundry operation.

Referring now to FIG. 4, a fluid inlet 96 for the appliance 12 may provide the process fluid 16 (e.g., water) to the fluid path 15. For example, the fluid inlet 96 may be a conduit, pipe, hose, or other supply device configured to carry the process fluid 16 into the appliance 12 from a water source. The fluid inlet 96 is in fluid communication with the drain conduit 39 via the one or more pumps, the filtration assembly 10, and/or one or more valves 98 that can control the flow of the process fluid 16 into or through the tub 18. The valves 98 may include a first valve 98*a* and a second valve 98*b*, with the first valve 98*a* corresponding to a pre-wash operation for the laundry appliance 12, and the second valve 98*b* corresponding to a washing cycle for the laundry appliance 12. Either or both of the valves 98 can be controlled via control signals provided by the controller 92 or another device for supplying electrical signals to the valves 98.

For example, the valves 98 may have electrical valves in the form of one or more solenoids that can open or close in response to electrical current flowing through the solenoid. Accordingly, the fluid path 15 can be interrupted by controlling the control signals to the valves 98 via the controller 92 or another device (e.g., a microswitch 106) supplying the control signals. In the illustrated and non-limiting aspect of the device, an electrical conduit 104 electrically couples with the microswitch 106 provided with the filtration assembly 10. The microswitch 106 is operably coupled with the pressure sensor 30, as will be further described herein, and is configured to energize or de-energize the valves 98 in response to the pressure sensor 30, or other fluid-related sensor, detecting the saturation condition of the file-particle filter 14.

Figure 5A:
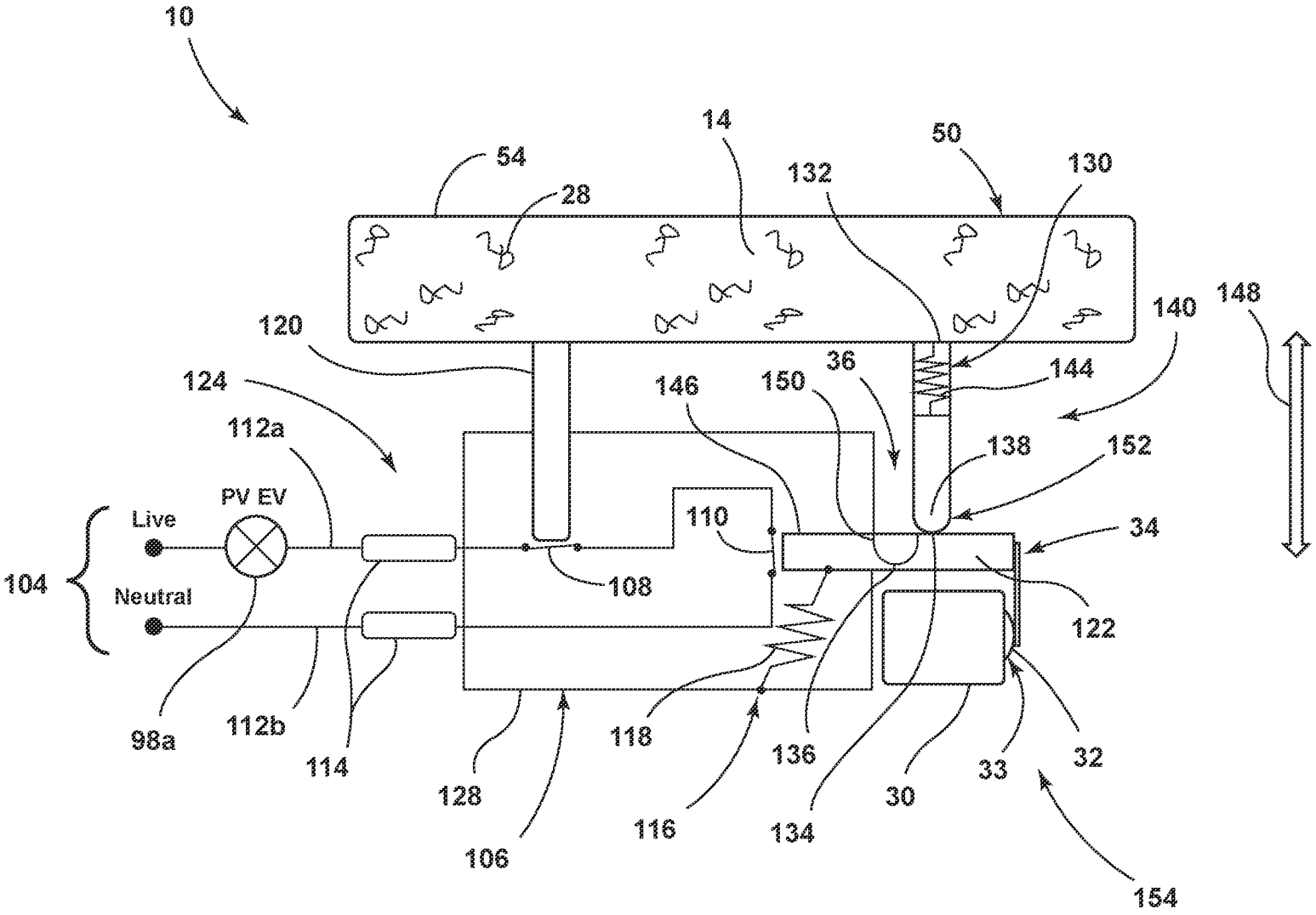
FIG. 5A is a schematic view of an exemplary filtration assembly that incorporates an interference feature illustrating a first unretained state with the filter of the filtration assembly disposal in the laundry appliance according to one aspect of the present disclosure.
Figure 5B:
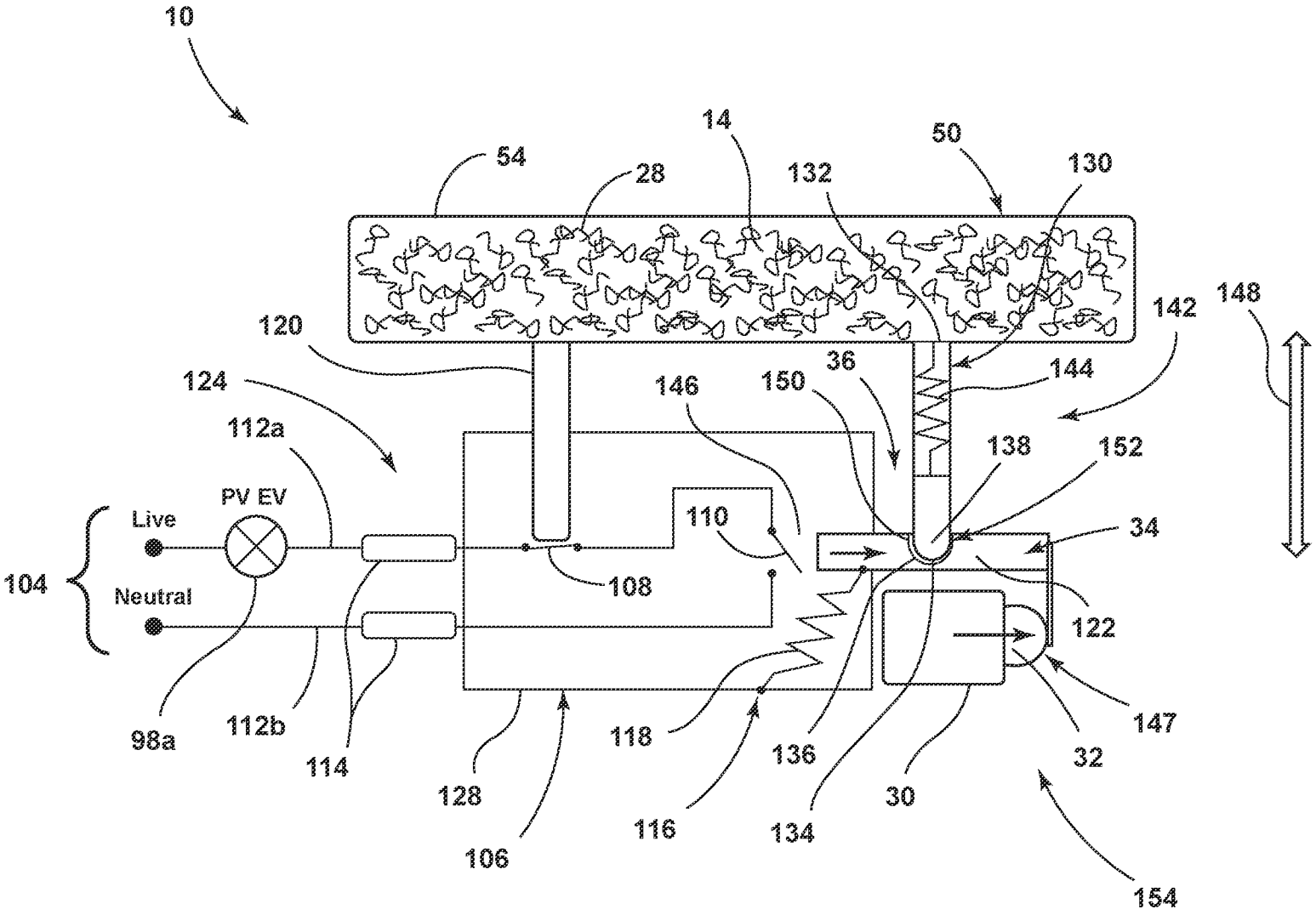
FIG. 5B is a schematic view of the exemplary filtration assembly of FIG. 5A illustrated in a retained state following saturation of the filter.
Figure 5C:
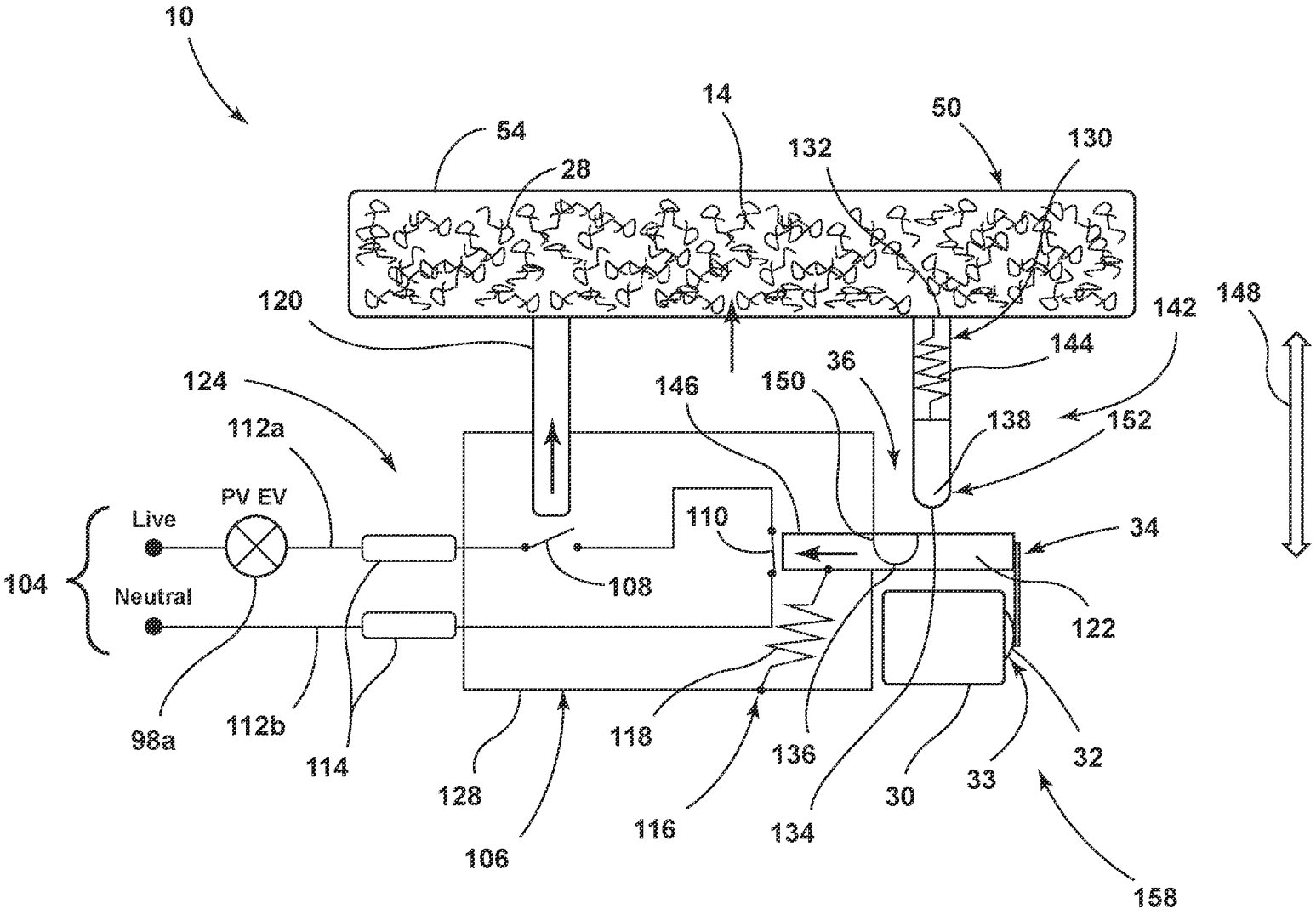
FIG. 5C is a schematic view of the exemplary filtration assembly of FIG. 5B illustrated in a second unretained state following removal of the filter of the filtration assembly.
Figure 5D:
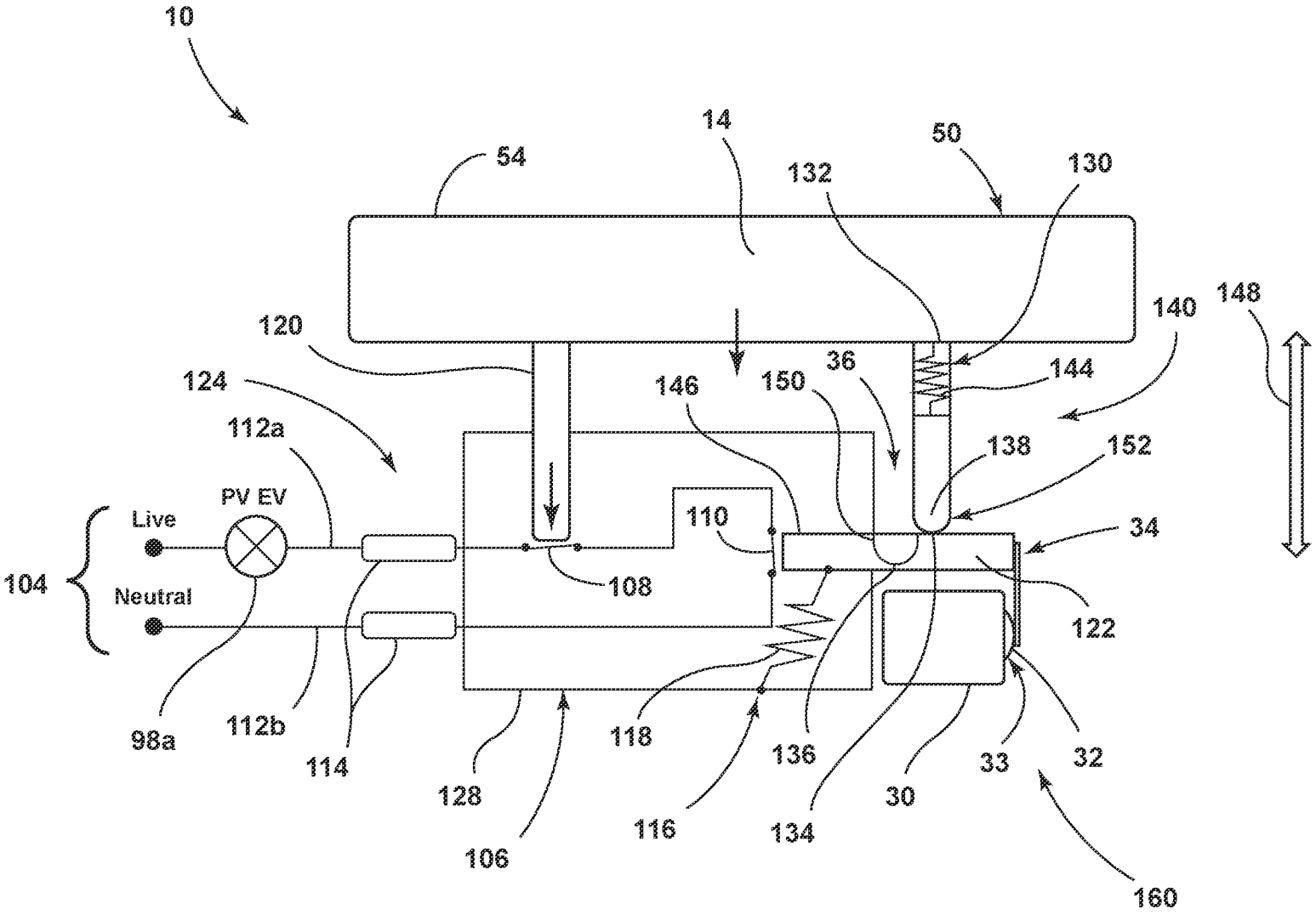
FIG. 5D is a schematic view of the exemplary filtration assembly of FIG. 5A illustrated in a third unretained state with the unsaturated filter of the filtration assembly being inserted into the laundry appliance.

Referring now to FIGS. 5A-5D, the filtration assembly 10 incorporates the microswitch 106 as previously described in reference to FIG. 4 according to one implementation. The microswitch 106 includes a first switch 108 and a second switch 110, with the first switch 108 in an electrical series connection with the second switch 110. A pair of electrical conductors 112, including a live conductor 112*a* and a neutral conductor 112*b* (e.g., first and second conductors of a 115 volt alternating-current (VAC), 120 VAC, 220 VAC, or other AC or direct-current (DC) circuit) are electrically coupled with the microswitch 106 via a pair of connectors 114. The first and second switches 108, 110 electrically interpose the first and second conductors 112*a*, 112*b*, such that a current path may be formed between the first and second conductors 112*a*, 112*b* and through the first and second switches 108, 110 when the first and second switches 108, 110 are in a closed position. A first biasing member 116, such as a spring 118, may be provided in the microswitch 106 for biasing the second switch 110 toward the closed position (exemplified in FIG. 5A). For example, a pair of shafts, including a first shaft 120 and a second shaft 122, are configured to selectively actuate the first and second switches 108, 110, respectively. The first biasing member 116 operably couples with the second shaft 122 and a component of the microswitch 106 (e.g., a microswitch housing 128) to bias the second shaft 122 toward a retracted position in which the second shaft 122 closes the second switch 110, as illustrated in FIGS. 5A, 5C and 5D. It is contemplated that the first shaft 120 may also be biased with another biasing device or may be fixed with the cartridge 50 for the filter 14. Accordingly, upon removal of the filter 14 from the filtration assembly 10, the first shaft 120 is moved away from the microswitch 106 and therefore away from the first switch 108 to open a filter detection circuit 124 formed by the first and second conductors 112*a*, 112*b* and the first and second switches 108, 110.

Still referring to FIGS. 5A-5D, the pre-wash valve 98*a* is in series with the first and second switches 108, 110 forming the filter detection circuit 124, which is de-energized upon opening of either of the first switch 108 or the second switch 110. For example, the pre-wash valve 98*a* may interpose the live conductor 112*a*, and upon an electrical potential being provided between the live conductor 112*a* and the neutral conductor 112*b* and the first and second switches 108, 110 being closed, the pre-wash valve 98*a* is energized to open fluid communication between the fluid inlet 96 and the tub 18 and/or the remainder of the fluid path 15. Accordingly, upon opening the first switch 108 or the second switch 110, or both, the pre-wash valve 98*a* is configured to close fluid communication between the fluid inlet 96 and the tub 18 and/or the remainder of the fluid path 15.

Still referring to FIGS. 5A-5D, the retention feature 36 for the filtration assembly 10 of the present disclosure is disposed between the second shaft 122 and a second biasing member 130 that is disposed between the filter 14 and the second shaft 122. The second biasing member 130 may have an elongated shape and extend between a first end 132 configured to engage the filter 14 and a second end 134 engaging the arm 34. For example, the second shaft 122 defines a notch 136 and the second biasing member 130 includes a protrusion 138 configured to engage the notch 136 to form the retention feature 36 between the filter 14 and the pressure sensor 30. The second biasing member 130 is movable between a compressed position 140 (FIGS. 5A and 5D) and an expanded position 142 (FIGS. 5B and 5C). In the compressed position 140, the second biasing member 130, which may include a spring 144, is compressed, or sandwiched, between an outer surface 146 of the second shaft 122 and the filter 14. Upon removal of the filter 14 or alignment with the notch 136, the second biasing member 130 is biased to move into the expanded position 142. Accordingly, when the filter 14 is present, the second biasing member 130 exerts a pushing force on the second shaft 122 until the second shaft 122 is moved to align the notch 136 with the second biasing member 130.

As previously described, the filtration assembly 10 includes the arm 34 that is operably coupled with the pressure sensor 30 and is selectively coupled with the filter 14 via the retention feature 36. In the present example, engagement of the retention feature 36 may be achieved by the membrane 32 of the pressure sensor 30 being moved away from the initial position 33 of the membrane 32 to an extended position 147. As previously described, the membrane 32 of the pressure sensor 30 moves from the initial position 33 in response to pressure caused by the saturation condition of the filter 14. For example, the pressure sensor 30 may be in communication with a detection fluid, such as air, having a pressure that may increase in response to the saturation condition causing the membrane 32 to extend.

As depicted, the second biasing member 130 may be disposed generally orthogonal relative to the second shaft 122, and the notch 136 may extend radially into the second shaft 122. The notch 136 may generally face, or extend into the second shaft 122, a direction common to an extension direction 148 of the second biasing member 130. The notch 136 includes a peripheral wall 150 that is configured to mate with or otherwise receive an end of the second biasing member 130. For example, the second biasing member 130 includes a pin 152 that is configured to extend or retract in response to the bias of the spring 144 and the second biasing member 130. When the notch 136 receives the pin 152, due to the force provided by the spring 144 of the second biasing member 130, the pin 152 engages the peripheral wall 150 of the notch 136 to lock the second shaft 122 in an extended position of the second shaft 122. Accordingly, via the arm 34, the membrane 32 of the pressure sensor 30 may be retained in the extended position 147 until the filter 14 has been removed Accordingly, as exemplified in FIG. 5B, exemplifying an aspect of the saturation condition, if the pressure inside the pressure sensor 30 is decreased below a particular threshold (or above a particular threshold) following detection of the saturation condition, the pressure sensor 30 may be nonetheless retain the membrane 32 in the extended position 147 through the engagement between the pin 152 and the notch 136. In this way, the filter detection circuit 124 remains open following the saturation condition due to the opening of the second switch 110 in response to the second shaft 122 being retained. As a result, power to the pre-wash valve 98*a* is disconnected and the pre-wash valve 98*a* closes the fluid communication from the fluid inlet 96 when the retention feature 36 is engaged. This configuration of the second shaft 122 retaining the membrane 32 in the extended position 147 remains until the filter 14 is removed. Removal of the filter 14 disengages the pin 152 from the notch 136 to allow retraction of the second shaft 122, thereby engaging and closing the second switch 110, as will be described more fully herein.

Once the filter 14 is removed via, for example, the cartridge 50, being removed, the first shaft 120 disengages the first switch 108 to open the first switch 108. Contemporaneously, the second biasing member is separated from the second shaft. As described herein, this removal causes the second shaft 122 to retract due to the biasing force provided by the first biasing member 116 to close the second switch 110. In this state, the filter detection circuit 124 remains open due to the open state of the first switch 108. Upon re-insertion of the filter 14, or insertion of a new filter 14, the first shaft 120 engages the first switch 108 to close the first switch 108 and thereby close the filter detection circuit 124.

Still referring to FIGS. 5A-5D, a sequence for the interference function is generally depicted using arrows to show motion for each step of the sequence. For example, with reference to FIG. 5A specifically, an initial unretained state 154 for the filtration assembly 10 depicts a normal operational behavior in which electrical current flows between the live and neutral conductors 112*a*, 112*b* due to the first and second switches 108, 110 of the microswitch 106 being in closed positions, respectively. In the initial unretained state 154, the filter 14 is not in the saturated condition, and the membrane 32 of the pressure sensor 30 therefore remains in the initial position 33. As a result, the second shaft 122 of the arm 34 is operable to close the second switch 110 based on the biasing force provided by the first biasing member 116. The presence of the filter 14 in the appliance 12 also engages the first shaft 120 with the switch 108 to close the first switch 108 of the microswitch 106.

With particular reference to FIG. 5B, which corresponds to a saturated condition of the filter 14, air pressure measured by the pressure sensor 30 causes the membrane 32 to move away from the initial position 33 toward the extended position 147 of the membrane 32. This motion of the membrane 32 biases the second shaft 122 to move the notch 136 into alignment with the pin 152. This motion of the membrane 32 and the second shaft 122 results in a retained state 156 of the filtration assembly 10 (e.g., the saturated or clogged condition of the filter 14). Accordingly, the biasing force provided by the first biasing member 116 can be overcome by the force of the membrane 32 of the pressure sensor 30 to move the second shaft 122 to the extended position of the second shaft 122, thereby disengaging the second shaft 122 from the second switch 110 and causing the second switch 110 to open. As a result, electrical current is limited from flowing through the filter detection circuit 124 and the solenoid of the pre-wash valve 98*a*. This limiting of the electrical current causes the pre-wash valve 98*a* to close fluid communication from the fluid inlet 96. The retention feature 36 is then formed between the second biasing member 130 and the second shaft 122. More particularly, the pin 152, or protrusion 138, of the second biasing member 130 engages the notch 136 to limit the second shaft 122 from returning toward the retracted position. Accordingly, the second shaft 122 may be maintained in the extended position until the filter 14 is removed and pressure measured by the pressure sensor 30 is relieved from a chamber 166 of the pressure sensor (see FIG. 6A).

With particular reference to FIG. 5C, a second unretained state 158 of the filtration assembly 10 corresponding to a removed state of the filter 14 from an installed position is depicted. When the filter 14 is removed, the second shaft 122 is returned to the retracted position following the second biasing member 130 being released from the notch 136. Once released, the biasing force of the first biasing member 116 (e.g., the spring 118 in the microswitch 106) causes the second shaft 122 to return to the retracted position and close the second switch 110. However, current may continue to be limited from flowing through the pre-wash valve 98*a* due to the first switch 108 remaining open. For example, upon removing the filter 14 from the laundry appliance 12, the first shaft 120 operably disengages the first switch 108 to keep the filter detection circuit 124 open until the filter 14 is returned or a new filter is inserted into the laundry appliance 12. It is appreciated that the first and second switches 108, 110 in the present example, are normally open switches, such that engagement of the first and second shafts 120, 122 with the first and second switches 108, 110, respectively, causes the first and second switches 108, 110 to close the detection circuit 124. When the filter 14 is removed, at least one of the first switch 108 and the second switch 110 electrically open the detection circuit 124.

With specific reference to FIG. 5D, insertion of the filter 14, after removal and mitigation of the saturated condition, causes the filter detection circuit 124 to close and cause electrical current to flow through the pre-wash valve 98*a* in a third unretained state 160, which is similar to the condition shown in FIG. 5A. Accordingly, the valve may open to allow fluid communication between the fluid inlet 96 and the tub 18. The closing of the filter detection circuit 124 is typically due to the first shaft 120, engaging and closing the first switch 108 and the second switch 110 remaining closed following removal of the filter 14 in the previous stage. Accordingly, the cycle illustrated in FIGS. 5A-5D can be repeated upon accumulation of pressure outside ordinarily experienced pressures in the pressure sensor 30 in response to the saturation condition of the filter 14.

It is contemplated that, although the microswitch 106 controls the control signal to the pre-wash valve 98*a* in the illustrated examples, such control signals may, in addition or in an alternative, be communicated by the controller 92. Further, feedback to the controller 92 via electrical coupling to the first and second conductors 112*a*, 112*b* may be provided to allow the controller 92 to detect when the pre-wash valve 98*a* or the washing valve are activated or deactivated. In some examples, circuitry in communication with the controller 92 is provided inside the pressure sensor 30, and movement of the membrane 32 causes closing or opening of feedback signals for the controller 92. Based on this information, the controller 92 can be configured to communicate the various messages to the HMI 94 to indicate a reason for operation of the laundry appliance 12 being interrupted. It is also contemplated that, although illustrated in reference to the pre-wash valve 98*a* in FIGS. 5A-5D, such operation of the wash valve 98*b* may be incorporated in order to control fluid flow during a wash cycle of the laundry appliance 12. Further, it is contemplated that the present interference function may be employed for controlling other fluid control components, such as the pumps 26, to maintain or interrupt various cycles during a wash cycle of the laundry appliance 12. For example, as will be described further in reference to FIGS. 7-11, the interference function may be employed for limiting the controller 92 from executing an operational cycle of the laundry appliance 12.

In general, the interference function shown and described in the preceding figures herein can provide for a physical connection between the pressure sensor 30 and the filter 14 that, in some instances, may only be broken upon removal of the filter 14 from the laundry appliance 12. Accordingly, the present disclosure may provide for reduced expansion to the controller 92 and/or electrical connections and limited complexity for software modification.

Figure 6A:
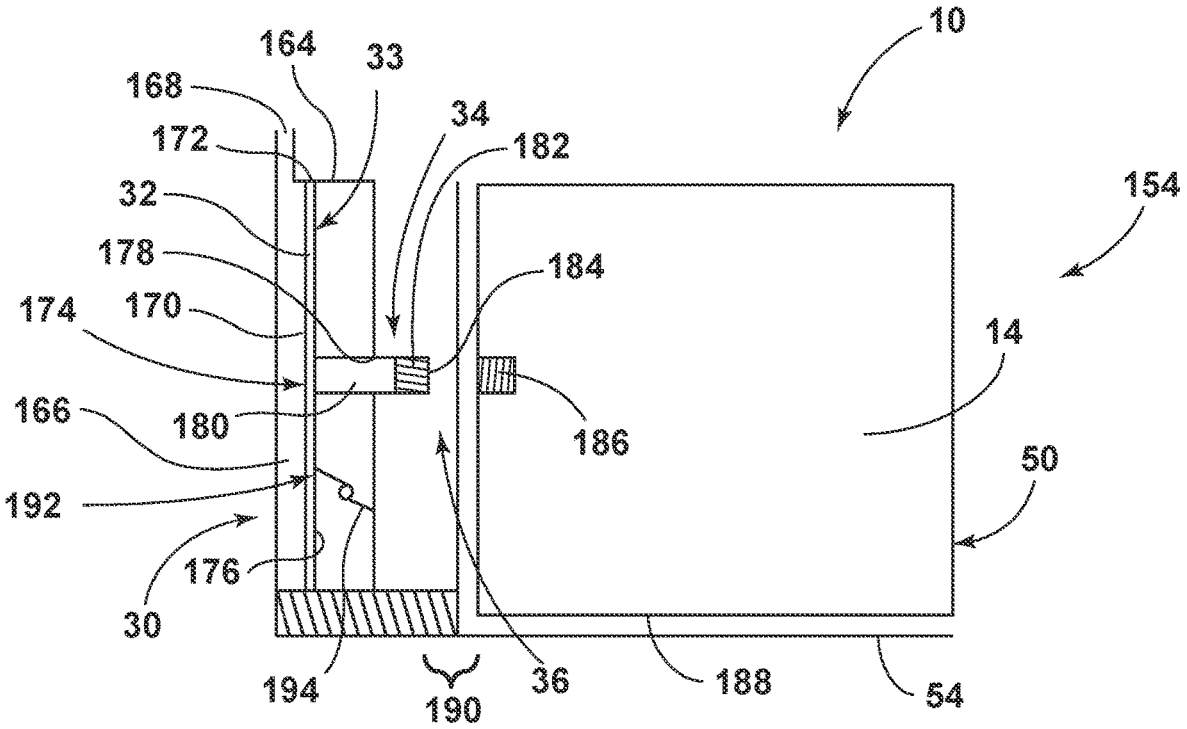
FIG. 6A is a cross-sectional view of an exemplary filtration assembly that incorporates an interference feature illustrating an unretained state with the filter of the filtration assembly in the laundry appliance according to one aspect of the present disclosure.
Figure 6B:
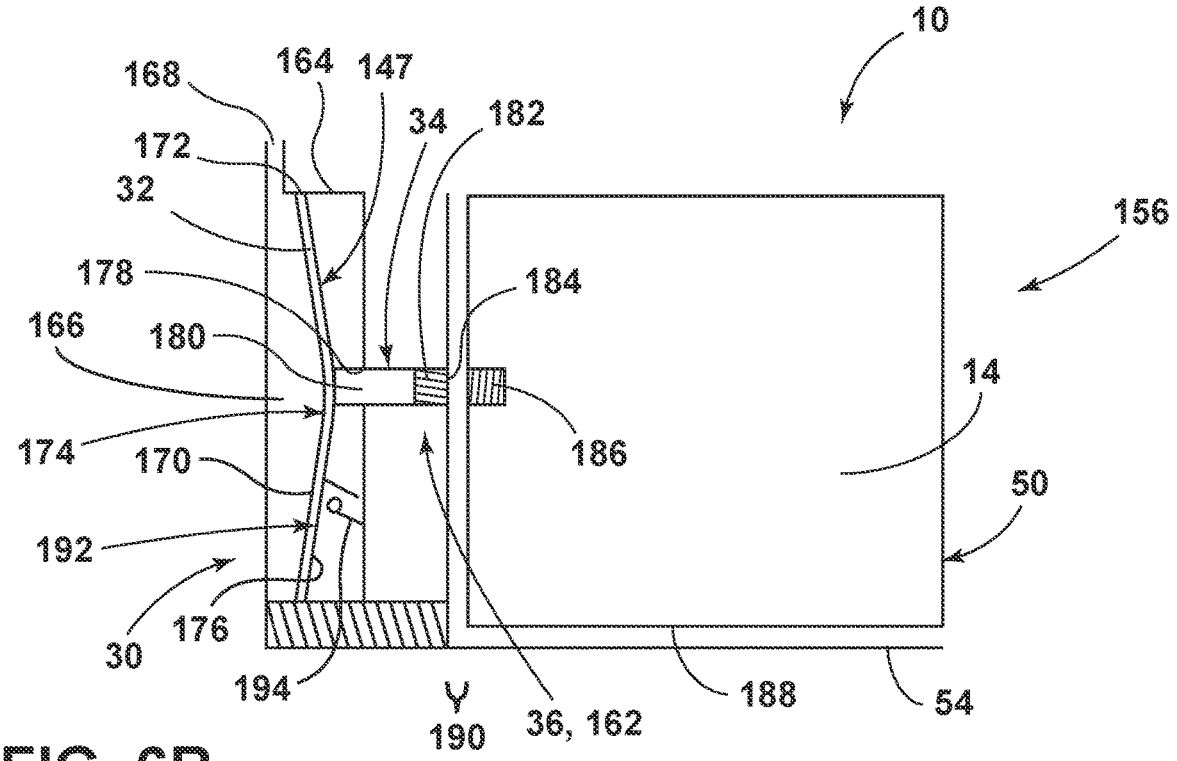
FIG. 6B is a cross-sectional view of the exemplary filtration assembly of FIG. 6A illustrated in a retained state following saturation of the filter of the filtration assembly.

Referring now to FIGS. 6A and 6B, another example of the filtration assembly 10 having the present filtration assembly 10 is provided in the initial state (FIG. 6A) and the retained state 156 (FIG. 6B). In the present example, the retention feature 36 includes a magnetic connection 162 (FIG. 6B) formed between the filter 14 and the pressure sensor 30 when the pressure sensor 30 responds to or detects the saturation condition. Accordingly, the retention feature 36 of the present example includes the magnetic connection 162, which may be broken upon removal of the filter 14 via removal of the filter 14 directly or removal of the cartridge 50. The pressure sensor 30 includes a sensor housing 164 that defines a chamber 166 that is in fluid communication with one or more spaces in the laundry appliance 12 that may house air and/or the process fluid 16. For example, the sensor housing 164 defines an air inlet 168 which may be in fluid communication with the tub 18 via a tube or hose and be configured to detect changes in fluid pressure, typically air pressure.

As a pressure corresponding to the saturated condition is reached, air in the chamber 166 may push on a first face 170 of the membrane 32 of the pressure sensor 30 to cause the membrane 32 to deform from the initial position 33 to the extended position 147. For example, the membrane 32, which may be circular in shape in some examples, may be fixedly secured to the housing along a perimeter 172 of the membrane 32 and spaced from the sensor housing 164 along the central portion 174 of the membrane 32. Upon a pressure increase on the first face 170 of the membrane 32, the membrane 32 deflects after reaching a threshold pressure corresponding to the saturation condition. The reaching of this threshold pressure causes the central portion 174 of the membrane 32 to deflect. In this way, the membrane 32 deforms to form a concave shape of the first face 170 and a corresponding convex shape of a second face 176, opposite the first face 170. As depicted in FIGS. 6A (the initial position 33) and 6B (the extended position 147), the central portion 174 of the membrane 32 pushes the arm 34 through the sensor housing 164.

With continued reference to FIGS. 6A and 6B, the sensor housing 164 defines a hole 178 that is in communication with the chamber 166 in which the arm 34 is disposed. For example, the arm 34 includes a body 180 that extends through the hole 178 between the chamber 166 and a region exterior to the chamber 166. The arm 34 is operably coupled with the membrane 32, such that movement of the membrane 32 causes corresponding movement of the arm 34. Similarly, movement or securement of the arm 34 may cause the membrane 32 to be moved or secured, such as the case for the interference condition illustrated in FIG. 6B in which the membrane 32 is retained in the extended position 147 relative to the filter 14 and filter housing 54.

It is contemplated that the hole 178 in the sensor housing 164 may be fluidly sealed around the arm 34, such that disposition of the arm 34 in the hole 178 does not result in air leakage through the hole 178 from the chamber 166. In this way, normal operation of the sensor membrane 32 of the pressure sensor 30 may continue. It is also contemplated that the body 180 of the arm 34 may be directly or indirectly coupled with the central portion 174 of the membrane 32 or another portion of the membrane 32. For example, a plate, which may be fastened to the membrane 32, can interpose the arm 34 and the membrane 32. In other examples, the body 180 of the arm 34 is coupled directly to the membrane 32 via fastener. It is contemplated that the arm 34 includes the body 180, as well as other mechanical linkages between the membrane 32 and the retention feature 36 formed from the magnetic connection 162.

As illustrated in FIG. 6B, upon deflection of the membrane 32 from the initial position 33 to the extended position 147, the arm 34 advances toward the filter housing 54 and the filter 14. A magnet 182 is disposed at a distal end 184 of the body 180. The filter 14 is provided with a metallic component 186 adjacent to a periphery 188 of the filter 14 that, when exposed to a magnetic field created by the magnet 182, causes the metallic component 186 and the magnet 182 to form the magnetic connection 162. Thus, the sizes and power of the magnet 182 and/or the metallic component 186 may be configured to secure the membrane 32 in the extended position 147, until such time as the filter 14 is removed and the magnet 182 is disengaged from the metallic component 186. Once the filter is removed, the membrane 32 and the attached arm 34 and the magnet 82 are returned to the initial position 33. Subsequently, when the filter 14 is present, the membrane 32 may remain in the initial position 33 until the saturation condition occurs again. Stated differently, while magnetic forces may be interacting between the magnet 182 and the metallic component 186 in the initial state illustrated in FIG. 6A, it is contemplated that such magnetic forces are limited due to a spacing 190 between the magnet 182 and the metallic component 186. Conversely, the changes to the spacing 190 illustrated in FIG. 6B (a reduction of the spacing 190), as a result of progressive saturation of the filter 14, will ultimately create a sufficient proximity between the magnet 182 and the metallic component 186 to generate the magnetic connection 162, thereby creating the retention feature 36 in the extended position 147. It is contemplated that, in some examples, the magnet 182 and the ferrous material (e.g., the metallic component 186) may be disposed in opposite location, such as the magnet 182 being in the filter and the metallic component being in the arm 34.

Still referring to FIGS. 6A and 6B, electrical switching circuitry 192 may be provided in the sensor housing 164 that allows detection of the saturation condition upon closing or opening of electrical contacts 194 within the pressure sensor 30. For example, deflection of the membrane 32 causes the membrane 32 to engage a mechanism that closes or opens one or more of the electrical switching circuitry 192 (e.g., contacts 194) in the pressure sensor 30. The electrical switching circuitry 192 is in communication with the controller 92 or other operational components for the laundry appliance 12. Accordingly, by providing the magnetic connection 162 formed between the filter 14 and the membrane 32 when the membrane 32 is in the extended position 147, the electrical switching circuitry 192 is opened upon the saturation condition and held in the open position until the filter 14 is removed and the saturation condition is no longer present. In other examples, the contacts 194 are normally-open contacts, and activation of the pressure sensor 30 (e.g., the saturation condition) causes closing of the contacts 194.

In operation, as pressure increases in the chamber 166 of the sensor housing 164 due to the accumulation of the microparticles 28 in the filter 14, the membrane 32 expands from the initial position 33 toward the extended position 147. Movement of the membrane 32 causes the arm 34 to move with the membrane 32, through the hole 178, and toward the metallic component 186. Once the saturation condition occurs and the pressure inside the chamber 166 has reached a threshold pressure, the magnet 182 is in close proximity to the metallic component 186. As a result, the magnetic force between the magnet 182 and the metallic component 186 causes the arm 34 to be pulled toward the filter housing 54 to achieve the retention feature 36. The membrane 32 of the pressure sensor 30 is therefore latched in the extended position 147 via the magnetic connection 162 until the filter 14 is removed. Upon removal of the filter 14, and provided the air pressure is below the pressure threshold, the membrane 32 returns toward the initial position 33.

In general, the filtration arrangement shown and described in the preceding figures may provide for an interference function that activates when the filtration assembly 10 needs to be serviced due to clogging. The interference function may be achieved without requiring substantial modifications to existing hardware or software layouts or architectures for the laundry appliance 12 but may rather apply mechanical and/or electromechanical operations to provide the interference function. The resulting interference function may limit operation of the pumps 26, the valves 98, other hydraulic operational components that control the fluid path 15 through the laundry appliance 12, or the controller 92, as will be described below. By alerting the user to change the filter 14 and limiting operation of the laundry appliance 12 in response to the saturation condition, the present filtration assembly 10 may provide for increased recycling of microparticles 28 and a more efficient operation of the laundry appliance 12.

Referring now to FIGS. 7-11, reference number 200 generally refers to a control circuit for the laundry appliance 12. The control circuit 200 is configured with the interference function previously described, as well as a bypass function that allows operation of the laundry appliance 12 if the saturation condition is detected during an operational cycle, such as a wash cycle, of the laundry appliance 12. The control circuit 200 may achieve this dual functionality by selectively supplying an enable signal that allows for initiation of an operational cycle when the enable signal is present and limits initiation of an operational cycle when not present.

Still referring generally to FIGS. 7-11, the control circuit 200 for the laundry appliance 12 includes the controller 92 configured to operate the laundry appliance 12 in response to the enable signal. The control circuit 200 further includes a lock detection circuit 202 that monitors a lock 204 of a door 206 for the laundry appliance 12. The lock detection circuit 202 is configured to selectively communicate the enable signal. The filter detection circuit 124 electrically interposes the lock detection circuit 202 and the controller 92. The filter detection system monitors the filter 14 of the laundry appliance 12. A bypass circuit 208 electrically interposes the lock detection circuit 202 and the controller 92. The lock detection circuit 202 is configured to communicate the enable signal via the filter detection circuit 124 when the door 206 is unlocked and communicate the enable signal via the bypass circuit 208 when the door 206 is locked. In some examples, the enable signal is in electrical power for the controller 92. In some examples, the enable signal is an electrical signal to the lock 204 to energize the lock 204.

Figure 7:
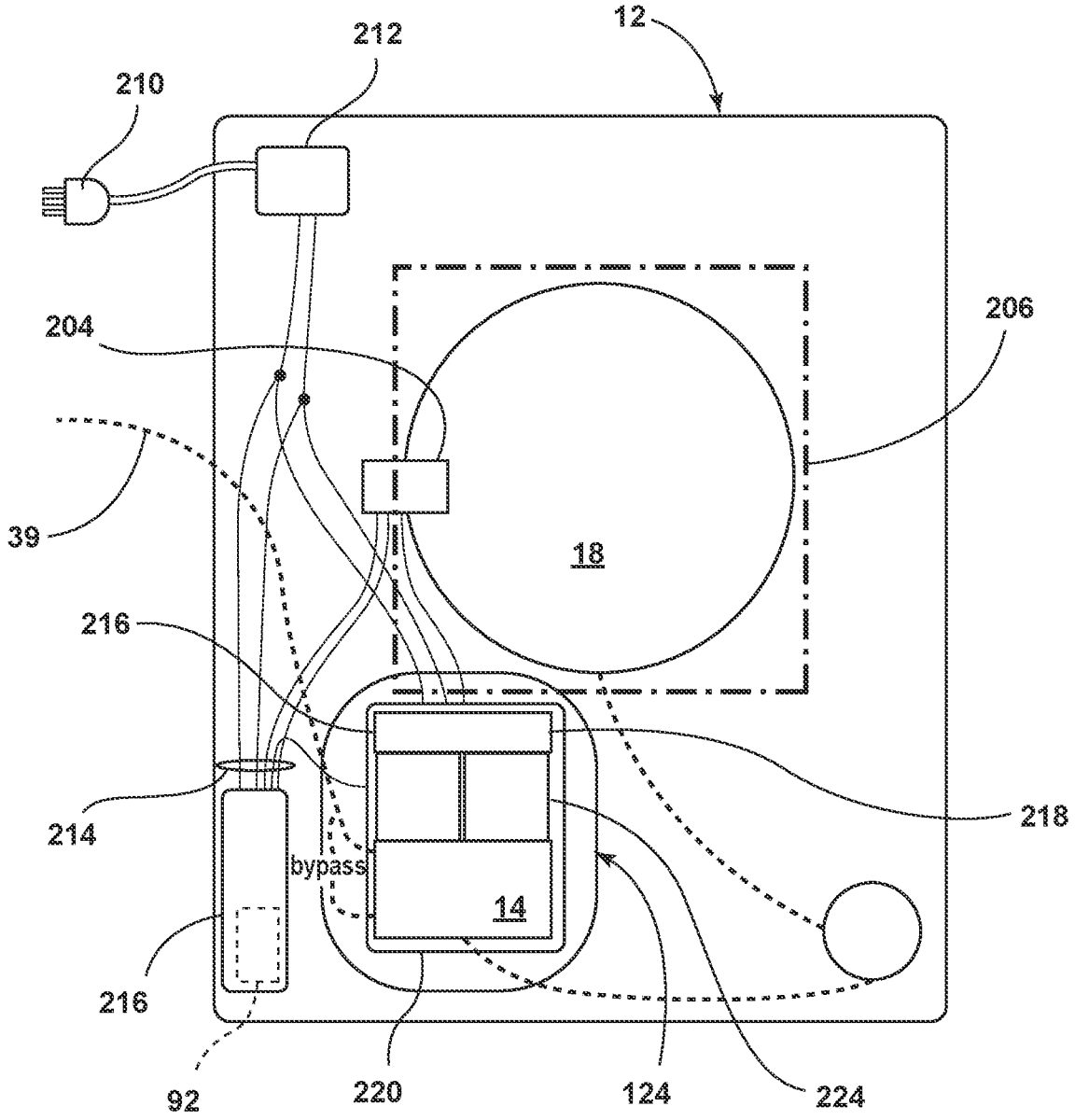
FIG. 7 is a schematic view of a laundry appliance incorporating an exemplary filtration assembly demonstrating electrical and fluid connections with the laundry appliance according to one example.

Referring now to FIG. 7, the door 206 of the laundry appliance 12 selectively covers the tub 18 to allow a user to selectively access the tub 18 or operate an operational cycle for the laundry appliance 12. As will further be described herein, when the door 206 is closed, the controller 92 may communicate a signal to the lock 204 to lock the door 206 and limit the user from opening the door 206. For example, when the door 206 is shut and a cycle is requested, the controller 92 may communicate a signal to activate the lock 204. As previously described, the controller 92 may selectively communicate this activation signal based on the presence of the enable signal at the controller 92. Alternatively, the enable signal may be a signal completing a circuit to energize the door lock 204.

Still referring to FIG. 7 a power connection 210 may be provided and electrically coupled with a radio-frequency interference (RFI) filter 212 configured to limit radio-frequency interference with power signals provided between the live and the neutral conductors 112*a*, 112*b* within the power connection 210. One or more wire harnesses 214 may be provided to interconnect the RFI filter 212, an appliance control unit (ACU 216) that includes the controller 92 (see also FIG. 4), the door lock 204, and the filter detection circuit 124. The one or more wiring harnesses 214 may refer to the physical interconnection of wiring between the elements described above, including wires carrying power signals, digital inputs/outputs, or analog inputs or outputs, or any other wire within the laundry appliance 12 carrying any electrical signals. The one or more wiring harnesses 214 may refer to a single wiring harness or a plurality of wiring harnesses that may be interconnected via wire ties or other fasteners mounted to, or free from walls of the laundry appliance 12.

In the present example, the filtration assembly 10 may incorporate at least a portion of the door lock detection circuit 202 and the filter detection circuit 124. For example, a relay 218 may be provided in communication with the door lock 204 and within a common unit 220 for the filtration assembly 10. The unit 220 may be a housing or other structure that may mechanically couple various portions of filtration assembly 10 (e.g., the pressure sensor 30, the microswitch 106, the relay 218, and/or other components). Although illustrated as being included in the unit 220, it is contemplated that the relay 218 may be disposed within the ACU 216 in an alternative.

Figure 8:
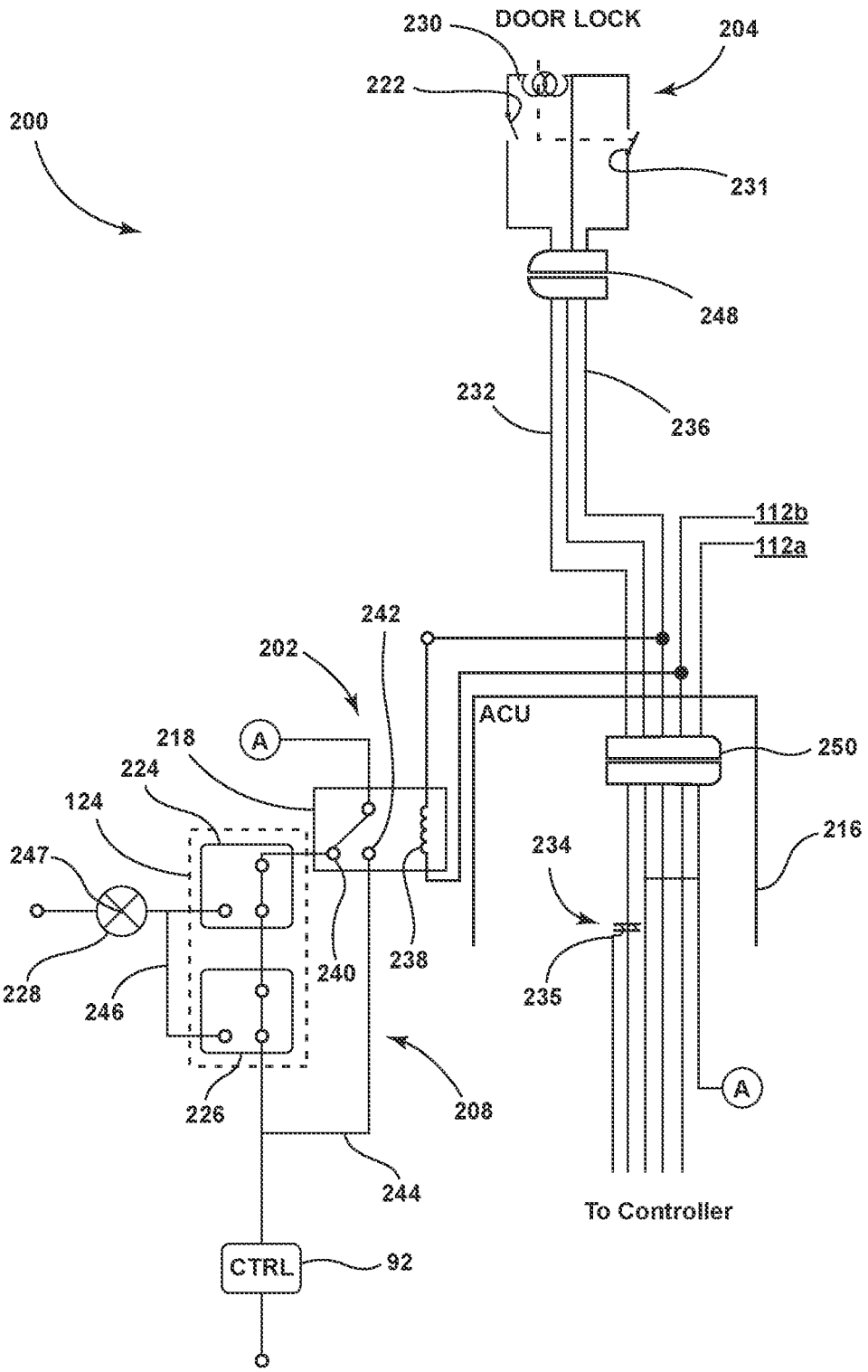
FIG. 8 is an electrical schematic of a control circuit for a laundry appliance according to one aspect of the present disclosure.

Referring now to FIG. 8, one example of the control circuit 200 is configured to selectively provide power to the controller 92 depending on the state of the door lock detection circuit 202 and the filter detection circuit 124. Thus, in this example, the enable signal is a power signal to the controller 92 that, when not present, limits electrical power to the controller 92 to limit operational cycles for the laundry appliance 12 from being initiated. The control circuit 200 includes the door lock 204, the door relay 218, a door switch 222, a saturation switch 224, a filter switch 226, an indicator 228, and the controller 92. The door lock 204 includes a solenoid 230 in electrical series connection with the door switch 222. The door lock 204 further includes a lock switch 231 electrically coupled with the solenoid 230. The lock switch 231 may close in response to activation of the solenoid 230. In some examples, the door lock 204 includes the solenoid 230 operable to lock the door 206 when energized, and the lock switch 231 is operably coupled with the solenoid 230 and configured to close when the door 206 is locked. The door switch 222 is in electrical series connection with the solenoid 230 and configured to detect a closed position of the door 206.

The solenoid 230 and the door switch 222 electrically interpose the live conductor 112*a* and the controller 92. In particular, a control node 232 may be communicatively coupled with the controller 92 and selectively activated by the controller 92 to selectively provide power across the solenoid 230 when the door switch 222 is closed (e.g., when the door 206 is closed). In some examples, the control node 232 extends between the door switch 222 and the at least one contact 240. In some examples, the controller 92 is configured to operate a triode for alternating current (TRIAC) 234 to control AC voltages to the solenoid 230 to cause and/or maintain the locked position of the door 206 of the appliance 12. Accordingly, the TRIAC 234 may interpose the controller 92 and the neutral conductor 112*b*, with a gate 235 of the TRIAC 234 being controlled by the controller 92.

Still referring to FIG. 8, the door lock switch 231 is configured to close when the door lock solenoid 230 is activated. In some examples, there is a delay between the activation/deactivation of the solenoid 230 and opening/closing of the door lock switch 231. For example, due to stored energy in the solenoid 230, electrical current may continue to flow through the door lock 204 switch for a brief period of time (e.g., microseconds to 0.1 seconds) following de-activation of the door lock 204. In some examples, the solenoid 230 refers to a wax motor having a heating element that may cause a plunger of the wax motor to extend to lock the door 206. In such examples, the delay between activation of the lock 204 and closing of the lock switch 231 may be greater (e.g., in the range of seconds to minutes). The delay between the activation of the solenoid 230 and closing of the door lock 204 may be detected by the controller 92 via a feedback node 236 extending between the lock 204 switch and the controller 92. For example, an internal timer of the controller 92 may be started when the control node 232 is activated and be stopped when the controller 92 detects the lock switch 231 being closed. If the internal timer exceeds a threshold time, the control circuit 200 may determine that the door 206 is not closed. Accordingly, while the controller 92 may activate the control node 232, such activation may be limited from reaching the solenoid 230 due to the door 206 being open, and thus the door switch 222 being open.

The feedback node 236 may also be in electrical connection with the door relay 218. For example, the feedback node 236 may extend between the lock 204 switch and a coil 238 of the door relay 218. In particular, the door relay 218 includes the coil 238 that, upon being energized via electrical potential between the feedback node 236 and the neutral conductor 112*b*, causes electrical communication between the live conductor 112*a* and the bypass circuit 208. For example, the door relay 218 includes at least one contact 240, 242, which may include a normally-closed contact 240 and a normally-open contact 242, such that, when the coil 238 is deenergized, the door relay 218 provides electrical communication between the live conductor 112*a* and the filter detection circuit 124 and limits electrical communication between the live conductor 112*a* and the bypass circuit 208. The coil 238 may be energized in response to the door 206 being locked and de-energized in response to the door 206 being unlocked. The enable signal may be configured to pass through the at least one contact 240, 242 and the filter detection circuit 124 when the coil 238 is de-energized and pass through the at least one contact 240, 242 and the bypass circuit 208 when the coil 238 is energized.

When the coil 238 is energized, the door relay 218 provides electrical communication between the live conductor 112*a* and the bypass circuit 208 and limits electrical communication between the live conductor 112*a* and the filter detection circuit 124. Accordingly, the delayed reaction between the signal to energize the solenoid 230 and the lock switch 231 being closed may be accounted for by the relay 218.

With continued reference to FIG. 8, the bypass circuit 208 may be a single bypass node 244 extending between the normally open contact 242 of the door relay 218 and an input to the controller 92. By providing the bypass circuit 208, so long as the door lock switch 231 is closed, the controller 92 may receive the enable signal through the normally open contact 242 of the door relay 218 and thus remain powered and operable to continue with a wash cycle, a rinse cycle, a spin cycle, or any other operational cycle of laundry appliance 12. In this way, following the initiation of a cycle, the cycle will finish independent of whether the filter 14 becomes saturated or is removed during the cycle. It is contemplated that, while the example includes a single bypass node 244 interconnecting the controller 92 with the normally open contact 242 of the door relay 218, other electrical components may be included in series with and interrupting the bypass node 244 in some examples, such as fuses, circuit breakers, or other devices that may, in some states of these electrical components, cause the controller 92 to lose power and terminate an operational cycle prematurely. It is contemplated that, in the examples that incorporate these additional electrical components in the bypass circuit 208, such electrical components may be limited to devices configured to limit irregular operations or irregular electrical conditions in which deactivation of the controller 92 is encouraged.

Still referring to FIG. 8, each of the filter switch 226 and the saturation switch 224 may correspond to the first switch 108 and the second switch 110, respectively, previously described with respect to FIGS. 5A-5D and as will be described further in reference to FIG. 9. In the example shown in FIG. 8, each of the filter switch 226 and the saturation switch 224 are two-way switches having three contact points (one input and two outputs). The input of the saturation switch 224 is electrically coupled with the normally closed switch of the door relay 218, such that, when the door relay 218 is not energized, the input of the saturation switch 224 is in electrical communication with the live conductor 112*a*. When the saturation condition is not present (e.g., the pressure sensor 30 is not expanded), the saturation switch 224 provides electrical communication between the live conductor 112*a* and the filter switch 226. When the saturation condition is present, the filter switch 226 may provide electrical communication between the live conductor 112*a* and the indicator 228 via a sink node 246 that electrically interposes the filter switch 226 and the indicator 228.

When the filter 14 is present in the filter housing 54, the filter switch 226 closes connection to the bypass circuit 208. When the filter 14 is not present, the filter switch 226 closes connection to the sink node 246. Thus, one state of the control circuit 200 allows electrical current to flow through the filter detection circuit 124 from the live conductor 112*a* to the controller 92, and another state allows electrical current to flow through the filter detection circuit 124 from the live conductor 112*a* to the indicator 228.

The indicator 228 may be a light emitting device, such as a light emitting diode (LED) 247 or an indicator lamp, such as an incandescent lamp, or any other electrical output device (e.g., an audio speaker) configured to communicate to a user an indication that the filter 14 is saturated or not present. In operation, the controller 92 may receive an input via, for example, a button or switch operable by the user, to start a cycle. If the door 206 is open, the filter 14 is not saturated, and the filter 14 is present, the controller 92 receives the enable signal in the form of electrical power between the live conductor 112*a* and the neutral conductor 112*b* by electrical current flowing from the live conductor 112*a*, through the normally closed contact 240 of the door relay 218, the saturation switch 224, and the filter switch 226, and to the controller 92. If the door 206 is shut (e.g., the door switch 222 is closed), the controller 92 communicates, via the TRIAC 234, an electrical signal to the door lock 204 to energize the solenoid 230.

In some examples, the filter detection circuit 124 includes the filter saturation switch 224 configured to selectively power one of the controller 92 and the indicator 228 based on the saturation condition of the filter 14. In one instance, the filter saturation switch 224 may be configured to power the indicator 228 in response to the filter 14 being saturated with microparticles 28 and the door 206 being unlocked. In another instance, the filter saturation switch 224 may be configured to provide the enable signal to the controller 92 in response to the door 206 being unlocked and the filter 14 being free from the saturation condition.

When the solenoid 230 is activated, the door lock switch 231 is closed, and the lock switch 231 is closed, the feedback node 236 communicates an electrical signal to the controller 92. In response, the controller 92 may verify that the door 206 has been locked. Further, in response to the door lock switch 231 being closed, the door relay 218 is energized, causing the normally open contact 242 to close and provide the enable signal, in the form of electrical power, to the controller 92. It is contemplated that, between deenergized and energized states of the door relay 218, the controller 92 may remain powered via additional circuits that may dissipate electrical energy in the form of current to the controller 92 to avoid electrical interruptions when no saturation condition and the filter 14 is present. In some examples, the switching time between the energized and deenergized states of the door relay 218 may be fast enough to limit electrical interruption to the controller 92 when no saturation condition and the filter 14 is present. The door relay 218 may be a solid-state relay or any other relay configured to activate and/or deactivate circuits in response to receiving an operating voltage.

Continuing with the exemplary operational cycle, if the filter 14 becomes saturated, the saturation switch 224 may close contact with between the normally closed contact 240 of the door relay 218 and the sink node 246. However, because this cycle is already initiated and the door relay 218 is energized, the live conductor 112*a* is not electrically connected with the sink node 246 in this state. Accordingly, the indicator 228 is off and the controller 92 continues to be powered despite clogging of the filter 14. Once the cycle finishes and the controller 92 deenergizes the solenoid 230, the door lock switch 231 is opened causing the coil 238 of the relay 218 to be deenergized. As previously described, there may be a delay between deenergizing of the solenoid 230 and opening of the door lock switch 231.

Following clogging of the filter 14 (e.g., the saturation condition), electrical current from the live conductor 112*a* is diverted from the bypass circuit 208 through the saturation switch 224 toward the indicator 228. The indicator 228 can then light up in response to being powered to indicate to the user that the filter 14 is either clogged or not present. As previously described with respect to FIGS. 1-6B, the user may remove the filter 14, resulting in the indicator 228 remaining on. For example, the saturation switch 224 may divert current toward the filter switch 226, and the filter switch 226 may direct current through the sink node 246 to the indicator 228. When the filter 14 is returned and the retention feature function is reset, electrical current can then flow from the live conductor 112*a*, through the door lock detection circuit 202 and the filter detection circuit 124 to the controller 92 to energize the controller 92. Accordingly, the control circuit 200 may allow for operational cycles to finish once started and limit subsequent operational cycles to initiate once the saturation condition is detected. In this example, enabling of the controller 92 is accomplished by powering the controller 92 via the bypass circuit 208 or the filter detection circuit 124.

Figure 10:
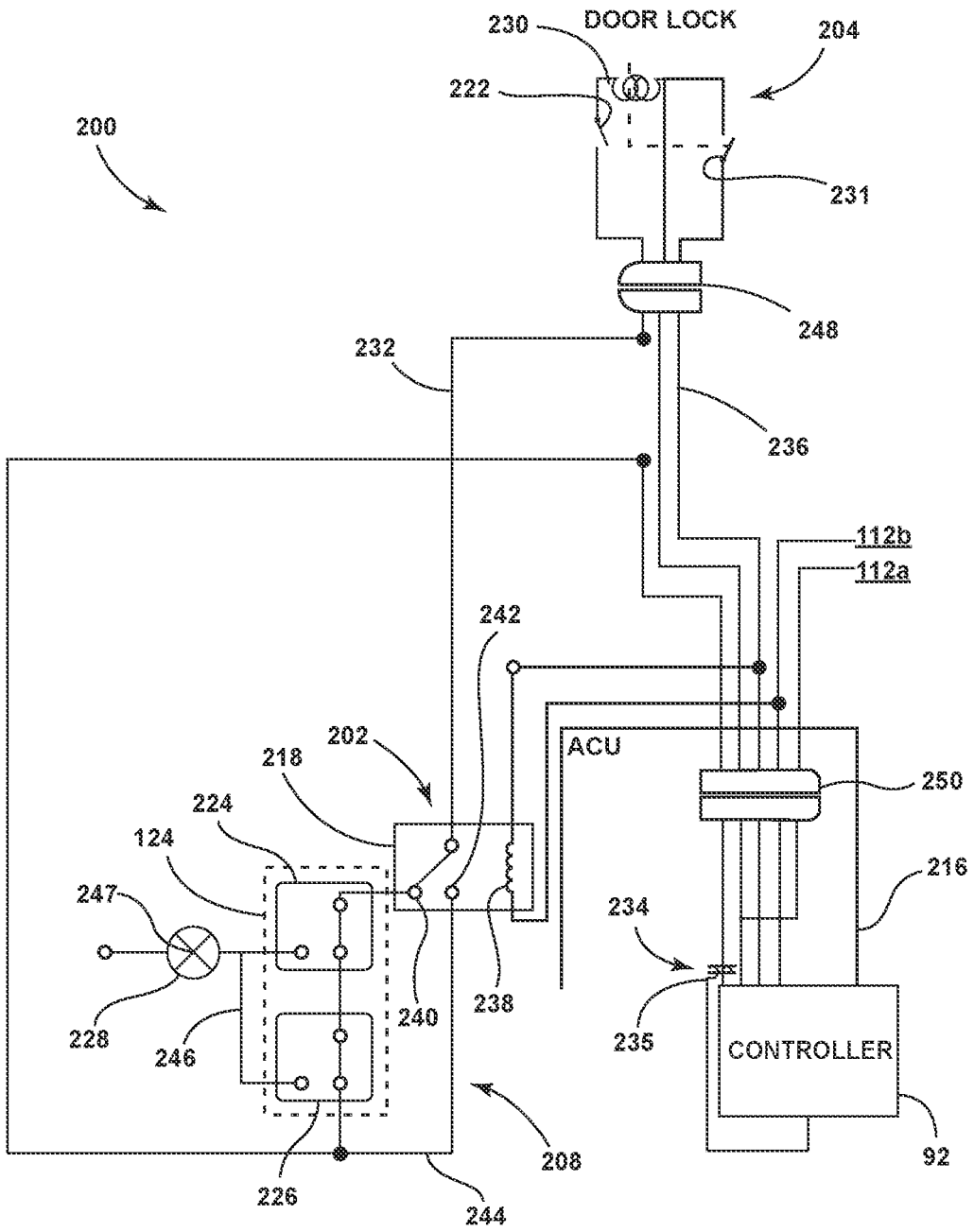
FIG. 10 is an electrical schematic of a control circuit for a laundry appliance according to one aspect of the present disclosure.

Referring more particularly to FIG. 10, the one or more wiring harnesses 214 may extend between the RFI filter 212, the door lock 204, the ACU 216, and the filtration assembly 10, as previously described. A plurality of connectors 248, 250 may be provided for selective attachment and detachment between these various devices. For example, a first connector 248 may be provided at the door lock 204, and a second connector 250 may be provided within the ACU 216 for connection with the controller 92. Although a connector is not illustrated between ACU 216 and the filtration assembly 10, it is contemplated that such a connector 248, 250 may be provided to allow for selective attachment and detachment during installation of the one or more wiring harnesses 214.

Figure 9:
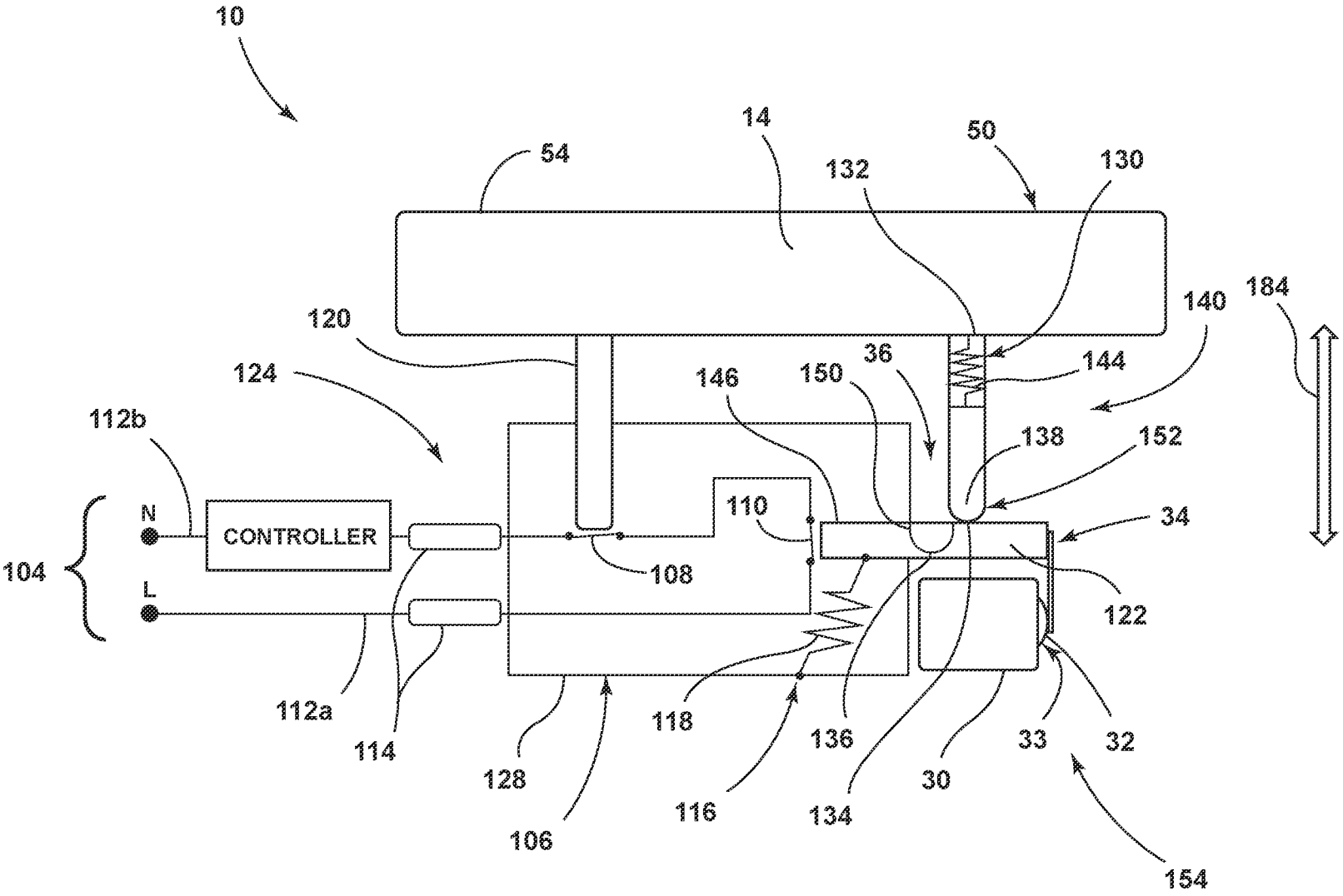
FIG. 9 is a schematic view of the exemplary filtration assembly utilizing a control circuit.

Referring now to FIG. 9, while the control circuit 200 of the present disclosure may be implemented with the magnetic connection 162 between the filter 14 and the pressure sensor 30 as previously described, the control circuit 200 is illustrated in connection with the microswitch 106. The interference function of the microswitch 106 of FIG. 9 may be performed in a like way as shown and described with respect to FIGS. 5A-5D but with power being selectively applied to the controller 92 rather than the pre-wash valve 98*a* or the wash valve 98*b*. In this example, when the filter 14 is present, the first switch 108, which may be operating as the filter switch 226, is closed, and the second switch 110, which may be operable as the saturation switch 224, is closed. When the filter 14 is removed, the first switch 108 may be opened, and when the saturation condition occurs, the second switch 110 opens and is held in the open position due to the interference function. Accordingly, electrical power may be removed from the controller 92 when either of the first or second switches 108, 110 is opened, though in alternative path (e.g., the bypass circuit 208) may continue to provide electrical power to the controller 92 when the door 206 is locked, as previously described with respect to FIG. 8. It is also contemplated that, while the first switch 108 and the second switch 110 are demonstrated as single pole dual-contact switches, each of the first and second switches 108, 110 may have a corresponding normally closed position that closes another circuit (e.g., the sink node 246). Accordingly, FIG. 9 is merely exemplary and may not illustrate all electrical connections previously described with respect to FIG. 8.

Referring now to FIG. 10, another example of the control circuit 200 controls communication of the enable signal via selective energizing of the control node 232 rather than the live conductor 112*a* directly. In this example, the controller 92 may remain powered by electrical communication with the live conductor 112*a* and the neutral conductor 112*b*. While operation between this example and the previous example shown and described with respect to FIG. 8 are similar and result in similar control logic, in the present example, the control node 232 interposes the door switch 222 and the contacts of the door relay 218 rather than interposing the door switch 222 and the controller 92. By interrupting the activation signal from the controller 92 to lock the door 206, initiation of an operational cycle may be prevented. Further, the controller 92 may detect that either the door 206 is not shut or the filter 14 is clogged.

Although not illustrated in detail, it is contemplated that the contacts previously described with respect to the magnetic connection 162 shown and described with respect to FIGS. 6A and 6B may be employed with the control circuit 200. For example, the contacts within the pressure sensor 30, which may open or closed depending on the state of the pressure sensor 30, may interact with the door relay 218 in a similar fashion to the first switch 108 and the second switch 110 as previously described. For example, the saturation switch 224 may correspond to a pair of contacts within the pressure sensor 30, such as a normally open and normally closed set of contacts of the pressure sensor 30. In this way, the electrical implementation of the present control circuit 200 may be employed with either of the interference functions described with respect to FIGS. 1-7.

Referring now to FIGS. 8-11, a logic table 252 (FIG. 11) demonstrates the states of the control circuit 200 in response to conditions of the filter detection circuit 124, the door lock detection circuit 202, the indicator 228, and the controller 92 (of the ACU 216). As demonstrated, either the indicator 228 or the controller 92 is energized and the other of the indicator 228 and the controller 92 is deenergized for each of the control circuit 200.

In general, the control circuit 200 of the present disclosure may provide for universality for a plurality of types and models of laundry appliances that employ a microfiber filtration. Further, the use and application of the one or more harnesses 214 may allow for the enhanced modification and limited manufacturing revisions to incorporate the interference function and allow for limited interruptions after initiation of a wash cycle, a rinse cycle, a spin cycle, or any other operational cycle of the laundry appliance 12. Further, the electrical arrangement of the present control circuit 200 may limit expansion of the controller 92 and limit the need for software revisions or added inputs/outputs.

According to one aspect of the present disclosure, a laundry appliance includes a filter that accumulates microparticles in a fluid path, a pressure sensor having a membrane that moves from an initial position in response to the accumulation of the microparticles, an arm operably coupled with the pressure sensor, and a retention feature interposing the arm and the filter to operably couple the pressure sensor with the filter, wherein the retention feature maintains the membrane away from the initial position in response to the accumulation of the microparticles within the filter.

According to one aspect of the present disclosure, a laundry appliance includes a controller configured to operate the laundry appliance in response to an enable signal, a lock detection circuit that monitors a lock of a door for the laundry appliance, the lock detection circuit configured to selectively communicate the enable signal, a filter detection circuit electrically interposing the lock detection circuit and the controller and monitoring a filter of the laundry appliance, and a bypass circuit electrically interposing the lock detection circuit and the controller, wherein the lock detection circuit is configured to communicate the enable signal to the controller via the filter detection circuit when the door is unlocked and communicate the enable signal via the bypass circuit when the door is locked.

According to one aspect of the present disclosure, a laundry appliance includes a tub positioned within an outer cabinet, a drum that is rotationally operable within the tub, and a fluid pump that directs a process fluid through a fluid path that includes the tub, and a filter that accumulates microparticles in the fluid path, a pressure sensor having a membrane that moves from an initial position in response to the accumulation of the microparticles, an arm operably coupled with the pressure sensor, and a retention feature interposing the arm and the filter to operably couple the pressure sensor with the filter, wherein the retention feature maintains the membrane away from the initial position in response to the accumulation of the microparticles within the filter.

According to one aspect of the present disclosure, a filtration assembly for a laundry appliance includes a filter that captures microparticles in a fluid path. A pressure sensor has a membrane that moves from an initial position in response to a decrease in a fluid flow through the filter. An arm is operably coupled with the pressure sensor. A retention feature interposes the arm and the filter to operably couple the pressure sensor with the filter. The retention feature maintains the membrane away from the initial position in response to the decrease in the fluid flow through the filter and the filter remaining in the fluid path.

According to another aspect of the present disclosure, a laundry appliance includes a tub positioned within an outer cabinet. A drum is rotationally operable within the tub. A fluid pump directs a process fluid through a fluid path that includes the tub. A filtration assembly is in the fluid path and includes a filter that accumulates microparticles in the fluid path. A pressure sensor has a membrane that moves from an initial position in response to the accumulation of the microparticles. An arm operably couples with the pressure sensor. A retention feature interposes the arm and the filter to operably couple the pressure sensor with the filter. The retention feature maintains the membrane away from the initial position in response to the accumulation of the microparticles within the filter.

According to another aspect of the present disclosure, a filtration assembly for a laundry appliance includes a filter that captures microparticles in a fluid path. A pressure sensor has a housing that defines a chamber and a hole in communication with the chamber. The pressure sensor includes a membrane that is disposed in the housing and moves from an initial position in response to a decrease in a fluid flow through the filter. An arm extends through the passage and is operably coupled with the membrane. A magnetic connection is between the arm and the filter. The magnetic connection biases the membrane away from the initial position in response to the decrease in the fluid flow through the filter and the filter remaining in the fluid path.

According to another aspect of the present disclosure, a filtration assembly for a laundry appliance includes a filter that captures microparticles in a fluid path. A pressure sensor has a housing that defines a chamber and a hole in communication with the chamber. The pressure sensor includes a membrane that is disposed in the housing and moves from an initial position toward an extended position in response to a decrease in fluid flow through the filter. An arm extends through the passage and is operably coupled with the membrane. A magnetic connection is between the arm and the filter. The magnetic connection latches the membrane in the extended position in response to the membrane moving into the extended position.

According to another aspect of the present disclosure, a filtration assembly for a laundry appliance includes a filter that captures microparticles in a fluid path. A pressure sensor has a membrane that moves from an initial position in response to a decrease in a fluid flow through the filter. An arm is operably coupled with the pressure sensor. A biasing member moves toward a compressed position in response to engaging the filter at a first end of the biasing member and the arm at a second end of the biasing member. The arm defines a notch that receives the biasing member to bias the membrane away from the initial position in response to the decrease in the fluid flow through the filter and the filter remaining in the fluid path.

According to one aspect of the present disclosure, a laundry appliance comprising the filtration assembly constructed in accordance with any of the aspects of the present disclosure includes a tub positioned within an outer cabinet, a drum that is rotationally operable within the tub, and a fluid pump that directs a process fluid through the fluid path that includes the tub.

According to another aspect of the present disclosure, the filtration assembly further includes a control circuit for the laundry appliance and includes a controller configured to operate the laundry appliance in response to an enable signal. A lock detection circuit monitors a lock of a door for the laundry appliance. The lock detection circuit is configured to selectively communicate the enable signal. A filter detection circuit electrically interposes the lock detection circuit and the controller and monitors the filter of the laundry appliance. A bypass circuit electrically interposes the lock detection circuit and the controller. The lock detection circuit is configured to communicate the enable signal to the controller via the filter detection circuit when the door is unlocked and communicate the enable signal via the bypass circuit when the door is locked.

According to another aspect of the present disclosure, a control circuit for the laundry appliance includes a controller configured to operate the laundry appliance in response to an enable signal. A lock detection circuit monitors a lock of a door for the laundry appliance. The lock detection circuit is configured to selectively communicate the enable signal. A filter detection circuit electrically interposes the lock detection circuit and the controller and monitors the filter of the laundry appliance. A bypass circuit electrically interposes the lock detection circuit and the controller. The lock detection circuit is configured to communicate the enable via the filter detection circuit when the door is unlocked and communicate the enable signal via the bypass circuit when the door is locked.

According to one aspect of the present disclosure, the enable signal is electrical power for the controller.

According to one aspect of the present disclosure, the enable signal is an electrical signal to the lock to energize the lock.

According to one aspect of the present disclosure, the control circuit further includes a relay having a coil and at least one contact operably coupled with the coil, wherein the coil is energized in response to the door being locked and de-energized in response to the door being unlocked.

According to one aspect of the present disclosure, the enable signal is configured to pass through the at least one contact and the filter detection circuit when the coil is de-energized, and the enable signal is configured to pass through the at least one contact and bypass circuit when the coil is energized.

According to one aspect of the present disclosure, the bypass circuit includes a bypass node extending between the controller and the relay.

According to one aspect of the present disclosure, the lock includes a solenoid operable to lock the door when energized. The door lock further includes a lock switch operably coupled with the solenoid and configured to close when the door is locked.

According to one aspect of the present disclosure, the control circuit further includes a door switch in electrical series connection with the solenoid and configured to detect a closed position of the door.

According to one aspect of the present disclosure, the control circuit includes a control node extending between the door switch and the at least one contact.

According to one aspect of the present disclosure, the control circuit includes a feedback node extending between the lock switch and the coil.

According to one aspect of the present disclosure, the filter detection circuit includes a filter saturation switch configured to selectively power one of the controller and an indicator based on a saturation condition of the filter.

According to one aspect of the present disclosure, the filter saturation switch is configured to power the indicator in response to the filter being saturated with microparticles and the door being unlocked.

According to one aspect of the present disclosure, the filter saturation switch is configured to provide the enable signal to the controller in response to the door being unlocked and the filter being free from the saturation condition.

According to one aspect of the present disclosure, the retention feature includes a shaft coupled with the arm and a pin coupled with the filter, the shaft defining a notch configured to receive the pin to maintain the membrane.

According to one aspect of the present disclosure, the laundry appliance includes a spring configured to bias the pin against the shaft.

According to one aspect of the present disclosure, the laundry appliance includes an electrical switch engaged by the shaft in the initial position and that closes a filter detection circuit.

According to one aspect of the present disclosure, the pressure sensor includes a housing that defines a chamber and a hole in communication with the chamber, wherein the arm extends through the hole and operably couples with the membrane.

According to one aspect of the present disclosure, the laundry appliance includes a magnetic connection between the arm and the filter, wherein the magnetic connection maintains the membrane away from the initial position in response to a decrease in fluid flow through the filter.

According to one aspect of the present disclosure, the laundry appliance includes a tub positioned within an outer cabinet, a door having a lock for opening of the door, a drum that is rotationally operable within the tub, and a fluid pump that directs a process fluid through the fluid path that includes the tub.

According to one aspect of the present disclosure, the laundry appliance includes a controller configured to operate the laundry appliance in response to an enable signal.

According to one aspect of the present disclosure, a lock detection circuit monitors the lock and selectively communicates the enable signal.

According to one aspect of the present disclosure, a filter detection circuit monitors the filter and electrically interposing the lock detection circuit and the controller.

According to one aspect of the present disclosure, a bypass circuit electrically interposes the lock detection circuit and the controller, wherein the lock detection circuit is configured to communicate the enable signal to the controller via the filter detection circuit when the door is unlocked, and further configured to communicate the enable signal via the bypass circuit when the door is locked.

According to one aspect of the present disclosure, the enable signal is electrical power for the controller.

According to one aspect of the present disclosure, the enable signal is an electrical signal to the lock to energize the lock.

According to one aspect of the present disclosure, a relay has a coil and at least one contact operably coupled with the coil, wherein the coil is energized in response to the door being locked and de-energized in response to the door being unlocked and a bypass node extending between the controller and the relay.

According to one aspect of the present disclosure, a pressure sensor has a membrane that moves from an initial position in response to the accumulation of the microparticles, an arm operably coupled with the pressure sensor and a retention feature interposing the arm and the filter to operably couple the pressure sensor with the filter, wherein the retention feature maintains the membrane away from the initial position in response to the accumulation of the microparticles and the filter remaining in the fluid path.

According to one aspect of the present disclosure, a magnetic connection is between the arm and the filter, wherein the magnetic connection maintains the membrane away from the initial position in response to a decrease in fluid flow through the filter and the filter remaining in the fluid path.

According to one aspect of the present disclosure, the retention feature includes a shaft coupled with the arm and a pin coupled with the filter, the shaft defining a notch configured to receive the pin to maintain the membrane.

According to one aspect of the present disclosure, the enable signal is electrical power for the controller.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a filter that accumulates microparticles in a fluid path;

a pressure sensor having a membrane that moves from an initial position toward a saturated fluid impeding position in response to the accumulation of the microparticles;

an engaging arm operably coupled with the pressure sensor; and a retention feature that includes the engaging arm, the engaging arm selectively engaging a portion of the filter in the saturated fluid impeding position, the retention feature interposing the engaging arm and the filter to operably couple the pressure sensor with the filter, wherein the engaging arm of the retention feature maintains the membrane in the saturated fluid impeding position in response to a threshold saturation of the filter with the microparticles.

2. The laundry appliance of claim 1, wherein the retention feature includes a shaft coupled with the engaging arm and a pin coupled with the filter, the shaft defining a notch configured to receive the pin to maintain the membrane in the saturated fluid impeding position.

3. The laundry appliance of claim 2, further comprising a spring configured to bias the pin against the shaft.

4. The laundry appliance of claim 3, further comprising an electrical switch engaged by the shaft in the initial position that closes a filter detection circuit.

5. The laundry appliance of claim 1, wherein the pressure sensor includes a housing that defines a chamber and a hole in communication with the chamber, wherein the engaging arm extends through the hole and operably couples with the membrane.

6. The laundry appliance of claim 1, further comprising:

a tub positioned within an outer cabinet;

a door having a lock for opening of the door;

a drum that is rotationally operable within the tub; and a fluid pump that directs a process fluid through the fluid path that includes the tub.

7. The laundry appliance of claim 6, further comprising:

a controller configured to operate at least the drum and the fluid pump in response to an enable signal that allows for initiation of an operational cycle, and wherein the absence of the enable signal prevents initiation of the operational cycle.

8. The laundry appliance of claim 7, further comprising:

a lock detection circuit that monitors the lock and selectively communicates the enable signal.

9. The laundry appliance of claim 8, further comprising:

a filter detection circuit monitoring the filter and electrically interposing the lock detection circuit and the controller.

10. The laundry appliance of claim 1, wherein the fluid path is configured to direct air having the microparticles through the filter.

11. The laundry appliance of claim 10, wherein the pressure sensor includes a housing that defines a chamber and a hole in communication with the chamber, wherein the engaging arm extends through the hole and operably couples with the membrane.

12. The laundry appliance of claim 1, wherein the filter is selectively removable from the fluid path.

13. A laundry appliance, comprising:

a tub positioned within an outer cabinet;

a drum that is rotationally operable within the tub;

a fluid pump that directs a process fluid through a fluid path that includes the tub; and a filter that accumulates microparticles in the fluid path;

a pressure sensor having a membrane that moves from an initial position in response to the accumulation of the microparticles;

an engaging arm operably coupled with the pressure sensor; and a retention feature that includes the engaging arm, the engaging arm selectively engaging a portion of the filter in the saturated fluid impeding position, the retention feature interposing the arm and the filter to operably couple the pressure sensor with the filter, wherein the engaging arm of the retention feature maintains the membrane away from the initial position in response to the accumulation of the microparticles within the filter.

14. The laundry appliance of claim 13, wherein the retention feature includes a shaft coupled with the engaging arm and a pin coupled with the filter, the shaft defining a notch configured to receive the pin to maintain the membrane in the saturated fluid impeding position.

15. The laundry appliance of claim 14, further comprising a spring configured to bias the pin against the shaft.

16. The laundry appliance of claim 15, further comprising an electrical switch engaged by the shaft in the initial position that closes a filter detection circuit.

17. The laundry appliance of claim 13, further comprising:

a controller configured to operate at least the drum and the fluid pump in response to an enable signal that allows for initiation of an operational cycle, and wherein the absence of the enable signal prevents initiation of the operational cycle.

18. The laundry appliance of claim 17, further comprising:

a door having a lock; and a lock detection circuit that monitors the lock and selectively communicates the enable signal.

19. The laundry appliance of claim 18, further comprising:

a filter detection circuit monitoring the filter and electrically interposing the lock detection circuit and the controller.

20. The laundry appliance of claim 13, wherein the filter is selectively removable from the fluid path.

* * * * *